US006045681A

United States Patent [19]

Mori

[11] Patent Number: 6,045,681

[45] Date of Patent: Apr. 4, 2000

[54] MANUFACTURING METHOD OF PLANOGRAPHIC PRINTING PLATE SUPPORT AND PRESENSITIZED PLANOGRAPHIC PRINTING PLATE

[75] Inventor: Takahiro Mori, Hino, Japan

[73] Assignee: Konica Corporation, Tokyo, Japan

[21] Appl. No.: 09/099,382

[22] Filed: Jun. 18, 1998

[30] Foreign Application Priority Data

Jun. 23, 1997 [JP] Japan ..... 9-165756

[51] Int. Cl.[7] ..... C25D 5/44

[52] U.S. Cl. ..... 205/214; 205/172; 205/658; 204/DIG. 9

[58] Field of Search ..... 205/214, 172, 205/658; 204/DIG. 9

[56] References Cited

U.S. PATENT DOCUMENTS 5,174,869 12/1992 Uesugi et al. ..... 204/129.43
5,264,110 11/1993 Atkinson et al. ..... 205/214

FOREIGN PATENT DOCUMENTS 0 414 189 A1 2/1991 European Pat. Off. .
0 502 507 9/1992 European Pat. Off. .
0 545 092 A2 6/1993 European Pat. Off. .
2 100 751 1/1983 United Kingdom .

OTHER PUBLICATIONS

European Search Report May 10, 1998.

*Primary Examiner*—Kathryn Gorgos
*Assistant Examiner*—Thomas H. Parsons
*Attorney, Agent, or Firm*—Finnegan, Henderson, Farabow, Garrett & Dunner, L.L.P.

[57] ABSTRACT

Disclosed is a method of surface-roughening an aluminum support comprising the step of electrolytically surface-roughening an aluminum support in an electrolyte solution, supplying an alternating current with an alternating waveform having a positive polarity period and a negative polarity period in one cycle, and comprising arriving at the largest current value from a zero current value in the positive polarity period of one cycle and then falling, followed by rising to a current maximum in one cycle, wherein the time $t_1$, which is required to arrive at the largest current value, has the following relationships:

1 millisecond$<t_1 \leqq$10 milliseconds, and 1 millisecond$<t_1 \leqq$one third of the positive polarity period time.

10 Claims, 1 Drawing Sheet

MANUFACTURING METHOD OF PLANOGRAPHIC PRINTING PLATE SUPPORT AND PRESENSITIZED PLANOGRAPHIC PRINTING PLATE

FIELD OF THE INVENTION

The present invention relates to an electrolytically roughening method and a presensitized planographic printing plate, and particularly to a method of electrolytically surface-roughening a support for a planographic printing plate, and a presensitized planographic printing plate employing an aluminum support surface-roughened by the method.

BACKGROUND OF THE INVENTION

Heretofore, there has been employed an electrolytically surface-roughening method as one of methods for surface-roughening a support of a PS plate. There have been proposed various methods which employ various alternating current waveforms as a method of controlling the support surface properties. The methods include, for example, a method of employing an alternating waveform with voltage at a positive polarity period greater than voltage at a negative polarity period as disclosed in Japanese Patent Publication Nos. 55-19191 and 56-19280, a method of employing an alternating waveform in which a sine wave alternating current is phase-controlled by a thyristor as disclosed in Japanese Patent Publication No. 57-22036, a method of employing a three-phase alternating current as disclosed in Japanese Patent O.P.I. Publication No. 58-157997, and a method of employing an alternating current in which alternating currents having different cycles are synthesized as disclosed in Japanese Patent O.P.I. Publication No. 58-207374.

However, these methods, when an aluminum alloy support with relatively low purity is used, have a problem in that uniform pits on the support surface can not be obtained. In order to solve the problem, in Japanese Patent O.P.I. Publication No. 1-154797 discloses a method employing an alternating waveform in which an alternating current at a positive polarity period instantly reaches a maximum from zero, followed by a gradual decrease. In this method, in which the current instantly reaches a maximum from zero, however, the following problems are exhibited:

1. A waveform distortion results in non-uniformity in fine structure of the roughened surface of the support.

2. Overvoltage overloads the waveform generator, and is likely to result in mechanical trouble.

3. A presensitized planographic printing plate is prepared in which a light sensitive layer is provided on the support obtained by this method, and when ball point pen ink marks are put on the light sensitive layer in making a printing plate, the ink marks are likely to remain on the support surface without being removed by a developer (causing a ball point pen ink residue problem), resulting in stain occurrence during printing.

SUMMARY OF THE INVENTION

An object of the invention is to provide a method of electrolytically surface-roughening an aluminum support used for a planographic printing plate, the method solving the above mentioned problems, stably forming uniform pits in a honeycomb form on the support surface without causing mechanical trouble in a waveform generator or the like, and eliminating the ball point pen ink residue problem, and to provide a presensitized planographic printing plate employing an aluminum support surface-roughened by this method.

DETAILED DESCRIPTION OF THE INVENTION

Figure 1:
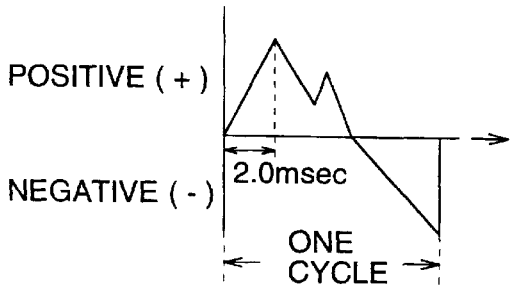
FIGS. 1(*a*) through 1(*f*) show examples of alternating current waveforms in which the polarity alternatingly varies.
Figure 1:
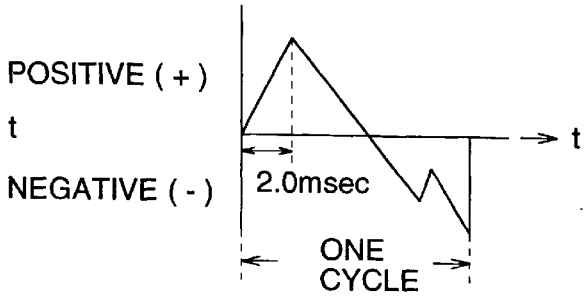
Figure 1:
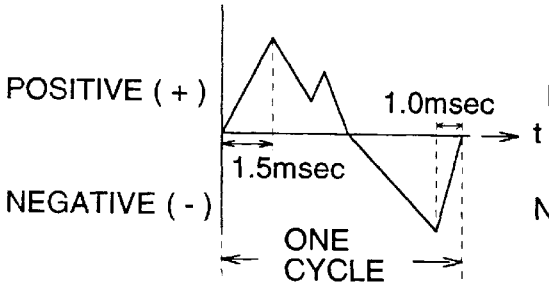
Figure 1:
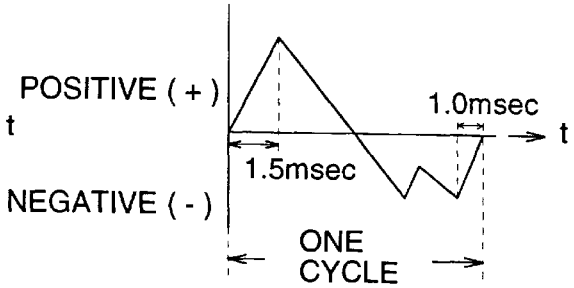
Figure 1:
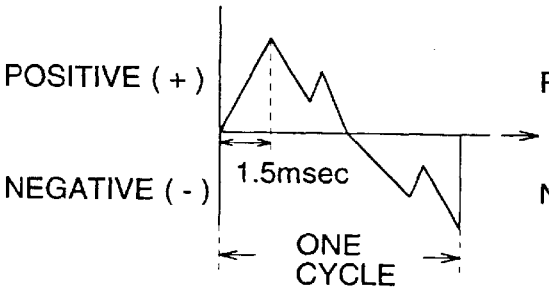
Figure 1:
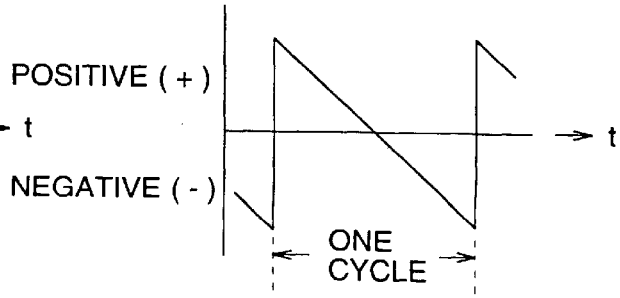

The above object of the invention can be attained by the followings:

1. A method of surface-roughening an aluminum support, the method comprising:

electrolytically surface-roughening an aluminum support in an electrolyte solution, supplying an alternating current with an alternating waveform having a positive polarity period and a negative polarity period in one cycle, and comprising arriving at the largest current value from a zero current value in the positive polarity period of one cycle and then falling, followed by rising to a current maximum in one cycle, wherein the time $t_1$, which is required to arrive at the largest current value, has the following relationships:

1 msec$<t_1\leqq$10 msec and 1 msec$<t_1\leqq$one third of the positive polarity period time 2. A presensitized planographic printing plate comprising a support and provided thereon, a light sensitive layer, wherein said support is obtained by etching the surface roughened support obtained according to item 1 above with an alkali solution, anodizing the etched support, and then post-treating or not post-treating the anodized support.

3. A method of surface-roughening an aluminum support, the method comprising:

electrolytically surface-roughening an aluminum support in an electrolyte solution, supplying an alternating current with an alternating waveform having a positive polarity period and a negative polarity period in one cycle, and comprising arriving at a zero current value from a finally occurring current minimum in the negative polarity period of one cycle, wherein the time $t_2$, which is required to arrive at the zero current value, has the following relationships:

$0<t_2$10 msec, and $0<t_2\leqq$one third of the negative polarity period time

4. A presensitized planographic printing plate comprising a support and provided thereon, a light sensitive layer, wherein the support is obtained by etching the surface roughened support obtained according to item 3 above with an alkali solution, anodizing the etched support, and then post-treating or not post-treating the anodized support.

5. A method of surface-roughening an aluminum support, the method comprising:

electrolytically surface-roughening an aluminum support in an electrolyte solution, supplying an alternating current with an alternating waveform having a positive polarity period and a negative polarity period in one cycle, and comprising (a) arriving at the largest current value from a zero current value in the positive polarity period of one cycle and then falling, followed by rising to a current maximum in one cycle, and (b) arriving at a zero current value from a finally occurring current minimum in the negative polarity period of one cycle, wherein the time $t_1$, which is required to arrive at the largest current value in the positive polarity period, and the time $t_2$, which is required to arrive at the zero current value in the negative polarity period, have the following relationships:

1 msec$<t_1 \leqq$10 msec, 1 msec$<t_1 \leqq$one third of the positive polarity period time, $0<t_2 \leqq$10 msec, and $0<t_2 \leqq$one third of the negative polarity period time 6. A presensitized planographic printing plate comprising a support and provided thereon, wherein the support is obtained by etching the surface roughened support obtained according to item 5 above with an alkali solution, anodizing the etched support, and then post-treating or not post-treating the anodized support, 7. The method of item 1, wherein the time $t_1$ has the following relationships:

1 millisecond$<t_1 \leqq$5 milliseconds, and 1 millisecond$<t_1 \leqq$one third of the positive polarity period time 8. The method of item 2, wherein the time $t_1$ has the following relationships:

1 millisecond$<t_1 \leqq$3 milliseconds, and 1 millisecond$<t_1 \leqq$one fourth of the positive polarity period time 9. The method of item 1, wherein the alternating waveform has one to five current maximums occurring after said falling in one cycle.

10. The method of item 1, further comprising the step of anodizing the surface roughened support to form an anodization layer.

11. The method of item 10, wherein the thickness of the anodization layer is 0.5 to 5.0 g/$m^2$.

12. The method of item 1, wherein the quantity of electricity supplied in the surface-roughening step is 100 to 2000 C/$dm^2$.

13. A method of manufacturing a presensitized planographic printing plate, the method comprising the steps of:

electrolytically surface-roughening an aluminum support in an electrolyte solution, supplying an alternating current with an alternating waveform having a positive polarity period and a negative polarity period in one cycle, and comprising arriving at the largest current value from a zero current value in the positive polarity period of one cycle and then falling, followed by rising to a current maximum in one cycle, wherein the time $t_1$, which is required to arrive at the largest current value, has the following relationships:

1 millisecond$<t_1 \leqq$10 milliseconds, and 1 millisecond$<t_1 \leqq$one third of the positive polarity period time; and providing a light sensitive layer on the surface-roughened support.

14. The method of item 13, wherein the light sensitive layer contains an o-quinonediazide compound.

The invention will be explained in detail as follows.

(Material of aluminum support)

An aluminum support used in the invention includes a support made of pure aluminum and that made of aluminum alloy. As an aluminum alloy, there can be used various ones including an alloy of aluminum and each of metals such as, for example, silicon, copper, manganese, magnesium, chromium, zinc, lead, bismuth, nickel, titanium, sodium and iron.

(Degreasing)

It is preferable that an aluminum support is subjected to a degreasing treatment for removing rolling oil prior to surface-roughening. The degreasing treatment to be used includes degreasing treatment employing solvents such as trichlene and thinner, and an emulsion degreasing treatment employing an emulsion such as kerosene or triethanol. It is also possible to use an aqueous alkali solution such as caustic soda for the degreasing treatment. When an aqueous alkali solution such as caustic soda is used for the degreasing treatment, it is possible to remove soils and oxidized films which cannot be removed by the above-mentioned degreasing treatment alone. After an aqueous alkali solution such as caustic soda is used for the degreasing treatment, it is preferable to conduct a neutralizing treatment by dipping in an acid such as phosphoric acid, nitric acid, hydrochloric acid, sulfuric acid and chromic acid, or in mixed acid thereof. When conducting electrolytical surface-roughening after the neutralizing treatment, it is especially preferable that an acid used for the neutralizing is matched with that used for the electrolytical surface-roughening.

(Surface-roughening treatment)

The surface-roughening of the invention is carried out, employing an alternating current in an acidic electrolytic solution. The time $t_1$ taken to arrive at the largest current value from a zero current value in the positive polarity period of one cycle has the following relationships:

1 msec$<t_1 \leqq$10 msec and 1 msec$<t_1 \leqq$one third of the positive polarity period time.

The $t_1$ has preferably the relationship, 1 msec$<t_1 \leqq$5 msec and 1 msec$<t_1 \leqq$one third of the positive polarity period time, and more preferably the relationships, 1 msec$<t_1 \leqq$3 msec and 1 msec$<t_1 \leqq$one fourth of the positive polarity period time.

The current value, after rising to the largest current value, falls. The current value rising rate is preferably 1.5 to 100 times the falling rate. The ratio of the positive polarity period time to the negative polarity period time, positive polarity period time/negative polarity period time, is preferably from 0.4 to 2.5, and more preferably 1.0 or more. The frequency used is preferably 5 to 250 Hz, more preferably 10 to 100 Hz, and most preferably 20 to 80 Hz. The number of current maximums, further occurring after the current arrives at the largest value and then falls, is preferably not more than 5, and more preferably not more than 2.

The time $t_2$ taken to arrive at a zero current value from the finally occurring current minimum in the negative polarity period of one cycle preferably has the following relationships:

$0<t_2 \leqq$10 msec, and $0<t_2 \leqq$one third of the negative polarity period time The $t_2$ has the relationship, more preferably $0<t_2 \leqq$5 msec and $0<t_2 \leqq$one third of the negative polarity period time, and most preferably $0<t_2 \leqq$2 msec and $0<t_2 \leqq$one third of the negative polarity period time.

The lower limitation of $t_2$ is preferably 0.01 msec, and more preferably 0.1 msec.

Though acidic electrolytic solutions ordinarily used can be used for electrolytical surface-roughening, it is preferable to use an electrolytic solution of the hydrochloric acid type or of the nitric acid type. The total quantity of electricity necessary to carry out the surface roughening treatment of the support may be continually applied in one electrolysis process, but can also be applied, being divided into several electrolysis processes which include a lower rate step with a lower current density and a zero rate step with no current being supplied. It is preferable in the latter case that the quantity of electricity is not more than 100 C/$dm^2$ in one step of the divided processes and the lower rate step or the zero rate step is carried out in 0.6 to 5 seconds. In the latter case, surface roughening is preferably carried out in a hydrochloric acid electrolyte solution, in view of obtaining a uniformly roughened surface.

When electrolytical surface-roughening is carried out by using an electrolytic solution of a nitric acid type, the voltage applied is preferably 1 to 50 V, and more preferably 5 to 30 V. Current density (the largest value) is preferably in the range of 10 to 200 A/dm$^2$, and more preferably in the range of 20 to 150 A/dm$^2$. The total quantity of electricity through the entire electrolytic surface-roughening process is 100 to 2000 C/dm$^2$, preferably in the range of 200 to 1500 C/dm$^2$, and more preferably in the range of 200 to 1000 C/dm$^2$. A temperature ranging from 10° C. to 50° C. is preferable, and a range of 15 to 45° C. is further preferable. The nitric acid concentration preferably ranges from 0.1 to 5% by weight, and more preferably ranges from 0.5 to 2.0% by weight. When necessary, it is possible to add, to the electrolytic solution, nitrates, chlorides, amines, aldehydes, phosphoric acid, chromic acid, boric acid, acetic acid or oxalic acid.

When electrolytical surface-roughening is carried out by using an electrolytic solution of a hydrochloric acid type, voltage applied is preferably 1 to 50 V, and more preferably 5 to 30 V. Current density (the largest value) is preferably in the range of 10 to 200 A/dm$^2$, and more preferably in the range of 20 to 150 A/dm$^2$. The total quantity of electricity through the entire electrolytic surface-roughening process is preferably in the range of 100 to 2000 C/dm$^2$, and more preferably in the range of 200 to 1000 C/dm$^2$. A temperature ranging from 10 to 50° C. is preferable, and a range of 15 to 45° C. is more preferable. The hydrochloric acid concentration preferably ranges from 0.1 to 5% by weight, and more preferably ranges from 0.5 to 2.0% by weight. When necessary, it is possible to add, to the electrolytic solution, nitrates, chlorides, amines, aldehydes, phosphoric acid, chromic acid, boric acid, acetic acid or oxalic acid. It is especially preferable that acetic acid is added in an amount of 0.1 to 5 weight % to the electrolytic solution of the hydrochloric acid type.

(Desmut treatment)

It is preferable that the support to have been surface-roughened according to the invention is dipped in an acid or an aqueous alkali solution so that the surface of the support is etched, for the purpose of removing smuts on the surface of the support and of controlling a shape of pits. The acid in this case includes, for example, sulfuric acid, persulfuric acid, hydrofluoric acid, phosphoric acid, nitric acid and hydrochloric acid, while, as the alkali, there may be given, for example, sodium hydroxide and potassium hydroxide. Among those mentioned above, an aqueous alkali solution is preferably used. The etching amount of the aluminum support, which is an aluminum amount including smuts removed by etching, is preferably 1.0 to 3.0 g/m$^2$. When an aqueous alkali solution is used for the etching treatment, it is preferable to immerse the etched support in an acid such as phosphoric acid, nitric acid, sulfuric acid or chromic acid, or in a mixed acid thereof, for neutralizing treatment. When conducting anodization treatment after the neutralizing treatment, it is preferable that an acid used for the neutralizing is matched with that used for the anodization.

After the surface-roughening treatment, anodization is preferably carried out to form an anodization layer on the support surface. Anodization is ordinarily carried out by supplying a direct electric current in an aqueous sulfuric acid solution, or an aqueous phosphoric acid solution, or a mixture solution thereof. An electrolytic surface-roughening method supplying a current density of 1 to 10 A/dm$^2$ is preferably used, however, it is also possible to use a method of electrolytically surface-roughening by supplying a high current density in sulfuric acid as described in U.S. Pat. No. 1,412,768 or a method of electrolytically surface-roughening the support in phosphoric acid as described in U.S. Pat. No. 3,511,661. The thickness of the anodization film is preferably 0.5 to 5.0 g/m$^2$, and more preferably 1.5 to 3.5 g/m$^2$. The density of micro pores that occur in the anodization film is preferably 400 to 700 per square meter, and more preferably 400 to 600 per square meter.

(Post-treatment)

The support which has been subjected to anodization treatment is optionally subjected to a sealing treatment. For the sealing treatment, it is possible to use known methods using hot water, boiling water, steam, a sodium silicate solution, an aqueous dichromate solution, a nitrite solution and an ammonium acetate solution. After a sealing treatment, a hydrophilic subbing layer is optionally provided on the support. The hydrophilic subbing layer can contain an alkali metal silicate disclosed in U.S. Pat. No. 3,181,461, a hydrophilic cellulose disclosed in U.S. Pat. No. 1,860,426, an amino acid or its salt disclosed in Japanese Patent O.P.I. Publication Nos. 60-149491 and 63-165183, amines having a hydroxy group or their salts disclosed in Japanese Patent O.P.I. Publication No. 60-232998, phosphate disclosed in Japanese Patent O.P.I. Publication No. 62-19494 and high polymer compounds including a monomer unit having a sulfo group disclosed in Japanese Patent O.P.I. Publication No. 59-101651.

Next, the light sensitive composition used in the invention will be explained.

The light sensitive composition used in the invention is not specifically limited, and in the invention, a conventional light sensitive composition used in a presensitized planographic printing plate can be used. The light sensitive composition used in the invention is as follows:

1) Photo-crosslinkable Light Sensitive Resin Composition

The light sensitive component in a photo-crosslinkable light sensitive resin composition includes a light sensitive resin having an unsaturated double bond in the molecule, for example, a light sensitive resin having —CH═CH(C═O)— as a light sensitive group in its main chain, or polyvinyl cinnamate having a light sensitive group in its side chain disclosed in U.S. Pat. Nos. 3,030,208, 3,435,237 and 3,622,208.

2) Photo-polymerizable Light Sensitive Resin Composition

The photo-polymerizable light sensitive resin composition contains an addition-polymerizable unsaturated compound. The composition is composed of a monomer having a double bond or a mixture of a monomer having a double bond and a polymer, and the example thereof includes those disclosed in U.S. Pat. Nos. 2.760,863 and 2,791,504.

The photo-polymerizable composition includes a composition containing methylmethacrylate, a composition containing methylmethacrylate and polymethylmethacrylate, a composition containing methylmethacrylate, polymethylmethacrylate and a polyethylene glycol methacrylate monomer, and a composition containing methylmethacrylate, an alkyd resin and a polyethylene glycol dimethacrylate monomer.

The photo-polymerizable light sensitive resin composition contains a photopolymerization initiator well known in the art such as a benzoin derivative such as benzoin, a benzophenone derivative such as benzophenone, a thioxanthone derivative, an anthraquinone derivative, or an acridone derivative.

3) Light Sensitive Composition containing Diazo Compound

The preferred diazo compound used in the light sensitive composition is a diazo resin obtained by condensation of an aromatic diazonium salt with formaldehyde or acetoaldehyde. Especially preferable is a salt of a condensation product of p-diazophenylamine with formaldehyde or acetoaldehyde, for example, a diazo resin inorganic salt such as a hexafluorophosphate, tetrafluoroborate, perchlorate or periodate salt of the condensation product, or a diazo resin organic salt such as a sulfonate salt of the condensation product disclosed in U.S. Pat. No. 3,300,309.

It is preferable that the diazo resin be used in combination with a binder. As such a binder, various high molecular compounds are available. Of these resins, preferred ones include copolymers between a monomer having an aromatic hydroxyl group such as N-(4-hydroxyphenyl)acrylamide, N-(4-hydroxyphenyl)methacrylamide, o-, m- or p-hydroxystyrene or o-, m- or p-hydroxyphenyl methacrylate and another monomer, as disclosed in Japanese Pat. O.P.I. Pub. No. 98613/1979; polymers containing hydroxyethyl acrylate units or hydroxyethyl methacrylate units as the repetitive unit, as disclosed in U.S. Pat. No. 4,123,276; natural resins such as shellac and rosin; polyvinyl alcohols; polyamide resins disclosed in U.S. Pat. No. 3,751,257; linear polyurethane resins disclosed in U.S. Pat. No. 3,660,097; phthalated polyvinyl alcohol resins; epoxy resins obtained from bisphenol A and epichlorohydrin; and cellulosic resins such as cellulose acetate and cellulose acetate phthalate.

4) Light Sensitive Composition containing o-Quinonediazide Compound

The o-quinonediazide compound is a compound having an o-quinonediazide group in the molecule. The o-quinonediazide compound used in the invention includes an o-naphthoquinonediazide compound such as an ester compound of o-naphthoquinonediazide sulfonic acid and a polycondensate resin of phenols with aldehydes or ketones.

Examples of the phenols used in the polycondensate resin of phenols with aldehydes or ketones include a monohydric phenol such as phenol, o-cresol, m-cresol, p-cresol, 3,5-xylenol, carvacrol and thymol, a dihydric phenol such as catechol, resorcin or hydroquinone, and a trihydric phenol such as pyrogallol or phloroglucin. Examples of the aldehydes include formaldehyde, benzaldehyde, acetaldehyde, crotonaldehyde and furfural. Preferred are formaldehyde and benzaldehyde. Examples of the ketones include acetone, and methyl ethyl ketone.

The examples of the polycondensate resin of phenols with aldehydes or ketones include a phenol-formaldehyde resin, a m-cresol-formaldehyde resin, a mixed m- and p-cresol-formaldehyde resin, a resorcin-benzaldehyde resin, and a pyrogallol-acetone resin.

In the o-naphthoquinonediazide compound, the condensation ratio of the o-naphthoquinonediazide sulfonic acid to the hydroxyl group of the phenol component is 15 to 80 mol %, and preferably 20 to 45 mol %.

The o-quinonediazide compound used in the invention include those disclosed in Japanese Patent O.P.I. Publication No. 58-43451. The examples thereof include conventional 1,2-quinonediazide compounds such as 1,2-benzoquinonediazidesulfonate, 1,2-benzoquinonediazidesulfonamide, 1,2-naphthoquinonediazide-sulfonate and 1,2-naphthoquinonediazidesulfonamide and, further, include 1,2-quinonediazide compounds such as 1,2-benzoquinonediazide-4-sulfonic acid phenyl ester, 1,2,1',2'-di-(benzoquinonediazide-4-sulfonyl)dihydroxybiphenyl, 1,2-benzoquinonediazide-4-(N-ethyl-N-β-naphthyl) sulfonamide, 1,2-naphthoquinonediazide-5-sulfonic acid cyclohexyl ester, 1-(1,2-naphthoquinonediazide-5-sulfonyl)-3,5-dimethylpyrazole, 1,2-naphthoquinonediazide-5-sulfonic acid-4'-hydroxydiphenyl-4'-azo-β-naphthol ester, N,N-di-(1,2-naphthoquinonediazide-5-sulfonyl)-aniline, 2'-(1,2-naphthoquinonediazide-5-sulfonyloxy)-1-hydroxyanthraquinone, 1,2-naphthoquinonediazide-5-sulfonic acid-2,4-dibydroxybenzophenone ester, 1,2-naphthoquinonediazide-5-sulfonic acid-2,3,4-trihydroxybenzophenone ester, a condensation product of 2 moles of 1,2-naphthoquinonediazide-5-sulfonic acid chloride with 1 mole of 4,4'-diaminobenzophenone, a condensation product of 2 moles of 1,2-naphthoquinonediazide-5-sulfonic acid chloride with 1 mole of 4,4'-dihydroxy-1,1'-diphenylsulfone, a condensation product between 1 mole of 1,2-naphthoquinonediazide-5-sulfonic acid chloride and 1 mole of purpurogallin, and 1,2-naphthoquinonediazide-5-(N-dihydroxyabiethyl)-sulfonamide described in J. Kosar, Light-Sensitive Systems, John Wily & Sons, New York, pp. 339–352 (1965) and W. S. De Forest, Photoresist, Vol. 50, McGraw-Hill, N.Y. (1975). Other examples are 1,2-naphthoquinonediazide compounds described in Japanese Pat. Exam. Pub. Nos. 37-1953, 37-3627, 37/13109, 40/26126, 40/3801, 45/5604, 45/27345 and 51/13013, and Japanese Pat. O.P.I. Pub. Nos. 48/96575, 48/63802 and 48/63803.

Among the above described o-quinonediazide compounds is especially preferable an o-quinonediazide ester compound obtained by reacting 1,2-benzoquinonediazide sulfonylchloride or 1,2-naphthoquinonediazide sulfonylchloride with a pyrogallol-acetone resin or 2,3,4-trihydroxybenzophenone.

In the invention, the o-quinonediazide compound may be used singly or in combination.

The o-quinonediazide compound content of the light sensitive layer is preferably 5 to 60% by weight, and more preferably 10 to 50% by weight.

The light sensitive composition containing the o-quinonediazide compound can further contain a clathrate compound.

Among the clathrate compounds, cyclic or acyclic D-glucans, cyclophanes or acyclic cyclopahane analogs are preferable. Further concretely, cyclodextrins, resorcinolaldehyde cyclic oligomers or para-substituted phenol alicyclic oligomer are preferable.

The still more preferable includes cyclodextrins or derivatives thereof, and the most preferable includes β-cyclodextrins or derivatives thereof.

The content of the clathrate compound in the light sensitive composition is preferably 0.01 to 10% by weight, and more preferably 0.1 to 5% by weight.

The light sensitive composition containing an o-quinonediazide compound preferably contains an alkali soluble resin. The alkali soluble resin used with the o-quinonediazide compound includes a novolak resin, a vinyl polymer having a phenolic hydroxy group, and a polycondensate of polyhydric phenol with aldehyde or ketone disclosed in Japanese Patent O.P.I. Publication No. 55-57841.

The above novolak resin includes a phenol-formaldehyde resin, a cresol-formaldehyde resin, a phenol-cresol-formaldehyde resin disclosed in Japanese Patent O.P.I. Publication No. 55-57841, and a copolycondensate of a p-substituted phenol, and phenol or cresol with formaldehyde disclosed in Japanese Patent O.P.I. Publication No. 55-127553.

The novolak resin has a number average molecular weight (Mn) of preferably $3.00\times10^2$ to $7.50\times10^3$, more preferably $5.00\times10^2$ to $4.00\times10^3$, and a weight average molecular weight (Mw) of preferably $1.00\times10^3$ to $3.00\times10^4$, more preferably $3.00\times10^3$ to $2.00\times10^4$, in terms of polystyrene standard.

The above novolak resin may be used singly or in combination.

When the novolak resin is used, the novolak resin content of the light sensitive layer is preferably 5 to 95% by weight.

The vinyl polymer having a phenolic hydroxy group herein referred to implies a polymer having a group with the phenolic hydroxy group in the polymer molecule structure, and preferably has a structural unit represented by the following formulas (I) through (V):

formula (I)

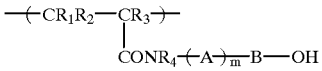

formula (II)

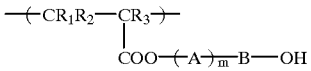

formula (III)

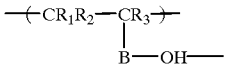

formula (IV)

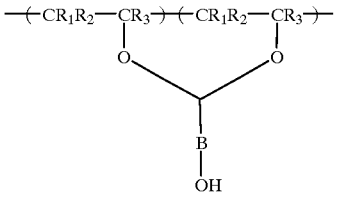

formula (V)

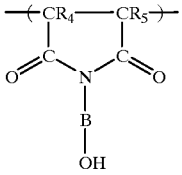

In formulas (I) through (V), $R_1$ and $R_2$ independently represent a hydrogen atom, an alkyl group or a carboxy group, and preferably represent hydrogen atoms; $R_3$ represents a hydrogen atom, a halogen atom or an alkyl group, and preferably represent a hydrogen atom or an alkyl group such as methyl or ethyl; $R_4$ and $R_5$ independently represent a hydrogen atom, an alkyl group, an aryl group or an aralkyl group, and preferably represent hydrogen atoms; A represents a substituted or unsubstituted alkylene group combining the aromatic carbon atom with the nitrogen or oxygen atom; m represents an integer of 0 to 10; and B represents a substituted or unsubstituted phenyl group or a substituted or unsubstituted naphthyl group.

The vinyl polymer used in the invention having the above phenolic hydroxy group is preferably a copolymer having the structures represented by formulas (I) through (V) above. The monomer used for copolymerization includes an ethylenically unsaturated olefin such as ethylene, propylene, isobutylene, butadiene or isoprene; styrene such as styrene, α-methylstyrene, p-methylstyrene or p-chloromethystyrene; acrylic acid such as acrylic acid or methacrylic acid; an unsaturated aliphatic dicarboxylic acid such as itaconic acid, maleic acid or maleic anhydride; an α-methylene aliphatic monocarboxylic acid ester such as methylacrylate, ethylacrylate, n-butylacrylate, isobutylacrylate, dodecylacrylate, 2-chloroethylacrylate, phenylacrylate, α-chloromethylacrylate, methylmethacrylate, ethylmethacrylate or ethylethacrylate, ethylacrylate; a nitrile such as acrylonitrile or methacrylonitrile; an amide such as acryl amide; an anilide such as m-nitroacrylanilide or m-methoxyacrylanilide; a vinyl ester such as vinyl acetate, vinyl propionate or vinyl benzoate; vinyl ether such as methylvinyl ether, ethylvinyl ether, isobutylvinyl ether or β-chloroethylvinyl ether; vinyl chloride; vinylidene chloride; vinylidene cyanide; an ethylene derivative such as 1-methyl-1-methoxyethylene, 1,1-dimethoxyethylene, 1,2-dimethoxyethylene, 1,1-dimethoxycarbonylethylene or 1-methyl-1-nitroxyethylene; and an N-vinyl monomer such as N-vinylindole, N-vinylpyrrolidine, or N-vinylpyrrolidone. These monomers are present in the copolymer in the cleavage form of the double bond.

Among the above monomers, the aliphatic monocarboxylic acid ester or nitrile is preferable, in that it exhibits the superior performance of the invention. The monomers may be contained in the copolymer at random or in the form of block.

When the vinyl polymer containing a phenolic hydroxy group is used, the polymer is contained in the light sensitive layer in an amount of preferably 0.5 to 70% by weight.

The vinyl polymer containing a phenolic hydroxy group may be used singly or in combination. The vinyl polymer may be used in combination with anothe polymer.

When the alkali soluble polymer is used, an o-quinonediazide compound content of the light sensitive layer is preferably 5 to 60% by weight, and more preferably 10 to 50% by weight.

5) As the light sensitive composition used in the invention, a light sensitive composition is also used which comprises a compound capable of generating an acid on exposure of an actinic light, a compound having a chemical bond capable of being decomposed by an acid or a compound having a group cross-linking by an acid, an infrared absorber, and optionally a binder. The compound capable of generating an acid on exposure of an actinic light, the compound having a chemical bond capable of being decomposed by an acid or the compound having a group cross-linking by an acid, the infrared absorber, and the binder will be explained below.

(Compound capable of generating an acid on irradiation of an active light)

The compound (hereinafter referred to as the acid generating compound in the invention) capable of generating an acid on irradiation of an active light used in the light sensitive composition of the invention includes various conventional compounds and mixtures. For example, a salt of diazonium, phosphonium, sulfonium or iodonium ion with $BF_4^-$, $PF_6^-$, $SbF_6^-$ $SiF_6^{2-}$ or $ClO_4^-$, an organic halogen containing compound, o-quinonediazide sulfonylchloride or a mixture of an organic metal and an organic halogen containing compound is a compound capable of generating or releasing an acid on irradiation of an active light, and can be used as the acid generating compound in the invention. The organic halogen containing compound known as an photoinitiator capable of forming a free radical forms a hydrogen halide and can be used as the acid generating compound of the invention.

The examples of the organic halogen containing compound capable of forming a hydrogen halide include those disclosed in U.S. Pat. Nos. 3,515,552, 3,536,489 and 3,779, 778 and West German Patent No. 2,243,621, and compounds generating an acid by photodegradation disclosed in West German Patent No. 2,610,842. The examples of the acid generating compounds used in the invention include o-naphthoquinone diazide-4-sulfonylhalogenides disclosed in Japanese Patent O.P.I. Publication No. 50-30209.

The preferable acid generating compound in the invention is an organic halogen containing compound in view of sensitivity to infrared rays and storage stability of an image forming material using it. The organic halogen containing compound is preferably a halogenated alkyl-containing triazines or a halogenated alkyl-containing oxadiazoles. Of these, halogenated alkyl-containing s-triazines are especially preferable. The examples of the halogenated alkyl-containing oxadiazoles include a 2-halomethyl-1,3,4-oxadiazole compound disclosed in Japanese Patent O.P.I. Publication Nos. 54-74728, 55-24113, 55-77742/1980, 60-3626 and 60-138539. The preferable examples of the 2-halomethyl-1,3,4-oxadiazole compound are listed below.

A

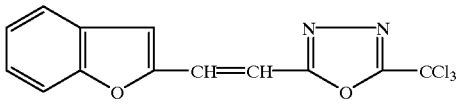

B

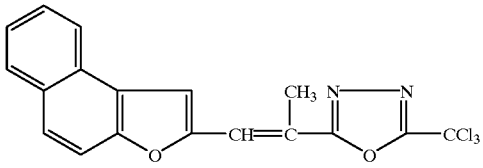

C

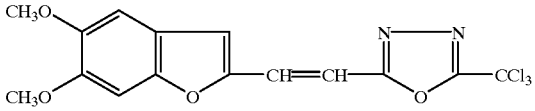

The halogenated alkyl containing triazines are preferably a compound represented by the following formula (1):

formula (1)

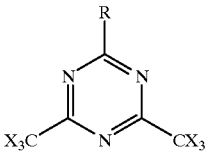

wherein R represents an alkyl group, a halogenated alkyl, an alkoxy group, a substituted or unsubstituted styryl group, or a substituted or unsubstituted aryl group; (for example, phenyl or naphthyl group) and $X_3$ represents a halogen atom.

The examples of an s-triazine acid generating compound represented by formula (1) are listed below.

(1)

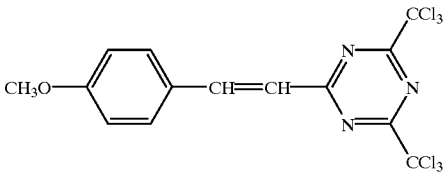

-continued (2)

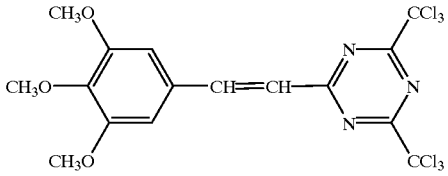

(3)

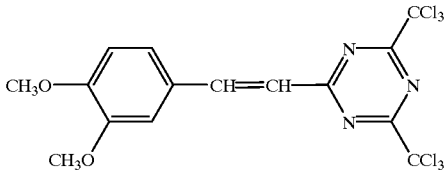

(4)

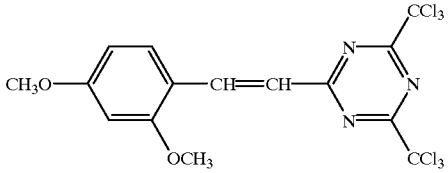

(5)

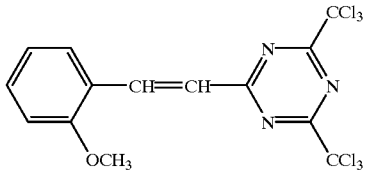

(6)

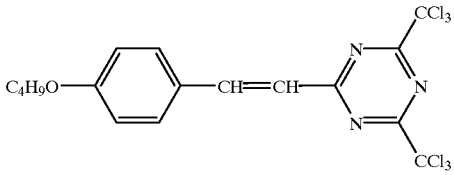

(7)

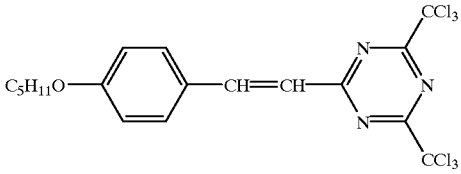

(8)

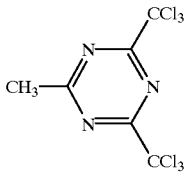

(9)

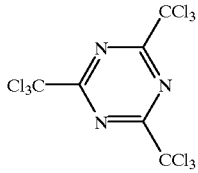

-continued (10)

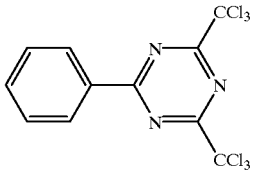

(11)

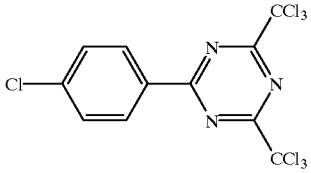

(12)

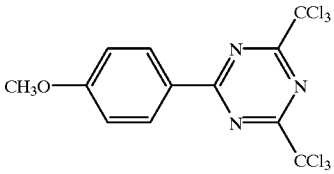

(13)

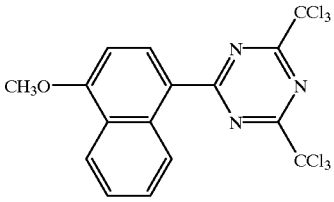

(14)

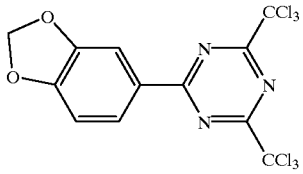

The content of the acid generating compound in the light sensitive composition is preferably 0.1 to 20% by weight, and more preferably 0.2 to 10% by weight based on the total weight of the solid components of the composition, although the content braodly varies depending on its chemical properties, kinds of light sensitive composition used or physical properties of the composition.

(Compound having a chemical bond capable of being decomposed by an acid)

The compound (hereinafter referred to also as the acid decomposable compound in the invention) having a chemical bond capable of being decomposed by an acid used in the invention includes a compound having a C—O—C bond disclosed in Japanese Patent O.P.I. Publication Nos. 48-89003/1973, 51-120714/1976, 53-133429/1978, 55-12995/1980, 55-126236/1980 and 56-17345/1981, a compound having an Si—O—C bond disclosed in Japanese Patent O.P.I. Publication Nos. 60-37549/1985 and 60-121446/1985, another acid decomposable compound disclosed in Japanese Patent O.P.I. Publication Nos. 60-3625/1985 and 60-10247/1985, a compound having an Si—N bond disclosed in Japanese Patent O.P.I. Publication No. 62-222246/1987, a carbonic acid ester disclosed in Japanese Patent O.P.I. Publication No. 62-251743/1987, an orthocarbonic acid ester disclosed in Japanese Patent O.P.I. Publication No. 62-2094561/1987, an orthotitanic acid ester disclosed in Japanese Patent O.P.I. Publication No. 62-280841/1987, an orthosilicic acid ester disclosed in Japanese Patent O.P.I. Publication No. 62-280842/1987, an acetal or ketal disclosed in Japanese Patent O.P.I. Publication No. .63-10153/1988 and a compound having a C—S bond disclosed in Japanese Patent O.P.I. Publication No. 62-244038/1987.

Of these compounds, the compound having a C—O—C bond, the compound having an Si—O—C bond, the orthocarbonic acid esters, the acetals or ketals or the silylethers disclosed in Japanese Patent O.P.I. Publication Nos. 53-133429/1978, 56-17345/1981, 60-121446/1985, 60-37549/1985, 62-209451/1987 and 63-10153/1988 are preferable. Of these compounds, especially preferable is a polymer disclosed in Japanese Patent O.P.I. Publication No. 53-133429/1978 which has a repeated acetal or ketal group in the main chain and increasing solubility in a developer by action of an acid or a compound capable of being decomposed by an acid disclosed in Japanese Patent O.P.I. Publication No. 63-10153/1988, which has the following structure:

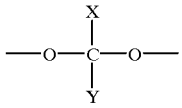

Wherein X represents a hydrogen atom or

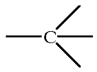

Y represents

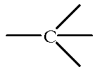

provided that X and Y may be the same or different.

The examples of the acid decomposable compound used in the invention include compounds disclosed in the above described patent specifications and their synthetic method is described in the above described patent specifications.

As the acid decomposable compound in the invention, orthocarbonic acid esters, acetals, ketals or silylethers, each having a $—(CH_2CH_2O)_n—$ group in which n is an integer of 1 to 5, are preferable in view of sensitivity and developability. Of the compounds having a $—(CH_2CH_2O)_n—$ group, n is especially preferably 1 to 4. The typical example of such a compound includes a condensation product of dimethoxycyclohexane, benzaldehyde or their derivative with diethylene glycol, triethylene glycol, tetraethylene glycol or pentaethylene glycol.

In the invention, the compound represented by the following formula (2) or (2') is preferable as the acid decomposable compound in view of sensitivity and developability.

formula (2)

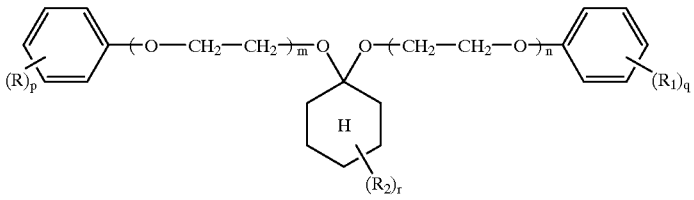

formula (2')

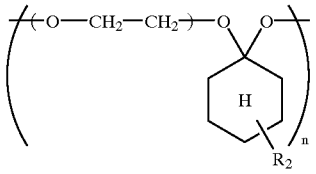

wherein R, $R_1$ and $R_2$ independently represent a hydrogen atom, an alkyl group having 1 to 5 carbon atoms, an alkoxy group having 1 to 5 carbon atoms, a sulfo group, a carboxyl group or a hydroxy group, p, q and r independently represent an integer of 1 to 3, and m and n independently represent an integer of 1 to 5. The alkyl group represented by R, $R_1$ and $R_2$ may be straight chained or branched, and includes a methyl group, an ethyl group, a propyl group, an isopropyl group, a butyl group, a tert-butyl group, and a pentyl group. The alkoxy group represented by R, $R_1$ and $R_2$ includes a methoxy group, an ethoxy group, a propoxy group, an isopropoxy group, a butoxy group, a tert-butoxy group, and a pentoxy group. In the compound represented by formula (2), m and n each especially preferably are 1 to 4. The compound represented by formula (2) or (2') can be prepared according to a conventional synthetic method.

The content of the acid decomposable compound in the light sensitive composition of the invention is preferably 5 to 70% by weight, and more preferably 10 to 50% by weight based on the total solid weight of the light sensitive composition. The acid decomposable compound in the invention can be used singly or in combination.

(Compound having a group cross-linking by an acid)

In the invention, the compound having a group cross-linking by an acid herein referred to is a compound (hereinafter referred to also as a cross-linking agent) cross-linking alkali soluble resins in the presence of an acid. The cross-linking agent cross-links the alkali soluble resin and lowers solubility in the alkali of the cross-linked alkali soluble resin. The alkali solubility lowering extent in the invention is such that the cross-linked alkali soluble resin is insoluble in the alkali. Concretely, when the light sensitive material is imagewise exposed which comprises a light sensitive layer containing the alkali soluble resin and the cross-linking agent on a support, the alkali soluble resin at exposed portions is cross-linked so that the cross-linked resin is insoluble in an alkali solution as a developer, in which the alkali soluble resin before exposure has been soluble in the developer, and the exposed material is developed with the developer to remain the exposed portions on the support. The cross-linking agent includes a compound having a methylol group or a methylol derivative group, a melamine resin, a furan resin, an isocyanate, and a blocked isocyanate (an isocyanate having a protective group). The cross-linking agent is preferably a compound having a methylol group or an acetoxymethyl group. The content of the cross-linking agent is preferably 1 to 80% by weight, and more preferably 5 to 60% by weight based on the total solid weight of the light sensitive composition of the invention.

(Infrared absorber)

The infrared absorber used in the invention includes an infrared absorbing dye having an absorption in the wavelength range of 700 nm or more, carbon black and magnetic powder. The especially preferable infrared absorber has an absorption maximum in the wavelength range of 700 nm to 850 nm and having a molar extinction coefficient, $\epsilon$ of $10^5$ or more.

The above infrared absorber includes cyanine dyes, squarylium dyes, chloconium dyes, azulenium dyes, phthalocyanine dyes, naphthalocyanine dyes, polymethine dyes, naphthoquinone dyes, thiopyrilium dyes, dithiol metal complex dyes, anthraquinone dyes, indoaniline metal complex dyes and intermolecular charge transfer complex dyes. The above described infrared absorber includes compounds disclosed in Japanese Patent O.P.I. Publication Nos. 63-139191/1988, 64-33547/1989, 1-160683/1989, 1-280750/1989, 1-293342/1989, 2-2074/1990, 3-26593/1991, 3-30991/1991, 3-34891/1991, 3-36093/1991, 3-36094/1991, 3-36095/1991, 3-42281/1991 and 3-103476/1991.

In the invention, the infrared absorber is especially preferably a cyanine dye represented by the following formula (3) or (4):

formula (3)

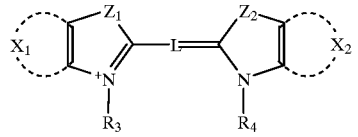

formula (4)

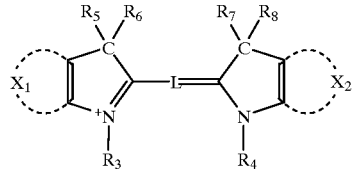

wherein $Z_1$ and $Z_2$ independently represent a sulfur atom, a selenium atom or an oxygen atom; $X_1$ and $X_2$ independently represent a non-metallic atomic group necessary to form a benzene or naphthalene ring, which may have a substituent; $R_3$ and $R_4$ independently represent a substituent, provided that one of $R_3$ and $R_4$ represents an anionic group, $R_5$, $R_6$, $R_7$ and $R_8$ independently represent a hydrogen atom, a halogen atom or an alkyl group having 1 to 3 carbon atoms; and L represents a linkage with a conjugated bond having 5 to 13 carbon atoms.

The cyanine dye represented by formula (3) or (4) includes a cyanine dye in which formula (3) or (4) itself forms a cation in its intramolecule and has an anionic group as a counter ion. The anionic group includes $Cl^-$, $Br^-$, $ClO_4^-$, $BF_4^-$, and an alkyl borate anion such as a t-butyltriphenyl borate anion.

The carbon number (n) in the linkage with a conjugated bond represented by L of formula (3) or (4) is preferably selected to match with wavelength of light emitted from an infrared laser used for exposure as a light source. For example, when a YAG laser, which emits 1060 nm light, is used, n is preferably 9 to 13. The conjugated bond may have a substituent, and may form a ring together with another atomic group. The substituent of the ring represented by $X_1$ or $X_2$ may be any, but is preferably a group selected from the group consisting of a halogen atom, an alkyl group having 1 to 5 carbon atoms, an alkoxy group having 1 to 5 carbon atoms, —$SO_3M$, and —COOM (in which M represents a hydrogen atom or an alkali metal atom). The substituent of $R_3$ and $R_4$ may be any, but is preferably an alkyl group having 1 to 5 carbon atoms, an alkoxy group having 1 to 5 carbon atoms, or —$((CH_2)_n—O—)_k—(CH_2)_mOR$ (in which n and m independently represent an integer of 1 to 3, k represents 0 or 1, and R represents an alkyl group having 1 to 5 carbon atoms), or preferably one of $R_3$ and $R_4$ represents —$RSO_3M$, and the other —$RSO_3^-$, in which R represents an alkylene group having 1 to 5 carbon atoms, and M represents an alkali metal atom, or preferably one of $R_3$ and $R_4$ represents —RCOOM, and the other —$RCOO^-$, in which R represents an alkylene group having 1 to 5 carbon atoms, and M represents an alkali metal atom. It is more preferable in view of sensitivity or developability that one of $R_3$ and $R_4$ represents —$RSO_3M$ or —RCOOM as described above, and the other —$RSO_3^-$ or —$RCOO^-$ as described above.

When a semiconductor laser is used for exposure as a light source, a dye represented by formula (3) or (4) is preferably a dye having an absorption peak in the range of 750 to 900 nm and a molar extinction coefficient $\epsilon$ exceeding $1\times10^5$, and when a YAG laser is used for exposure as a light source, a dye represented by formula (3) or (4) is preferably a dye having an absorption peak in the range of 900 to 1200 nm and a molar extinction coefficient $\epsilon$ exceeding $1\times10^5$.

The examples of the infrared absorber preferably used in the invention are listed below, but are not limited thereto.

IR1

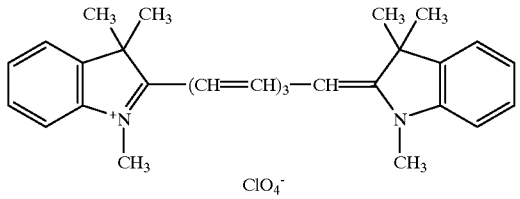

IR2

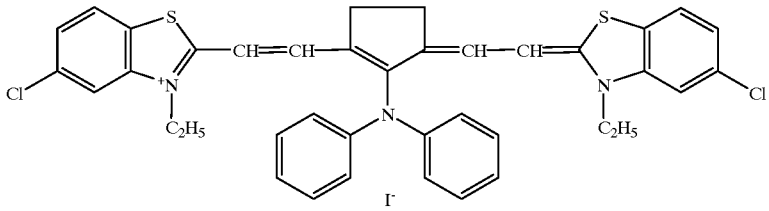

IR3

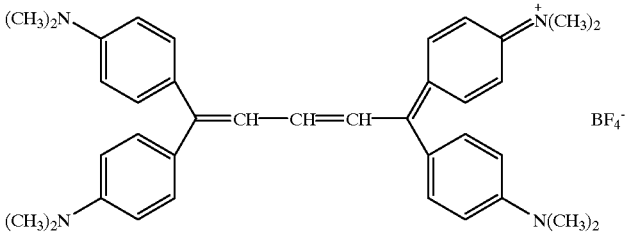

IR4

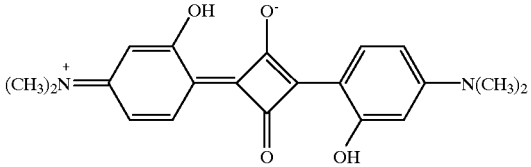

-continued
IR5
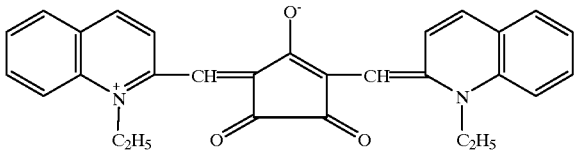
IR6
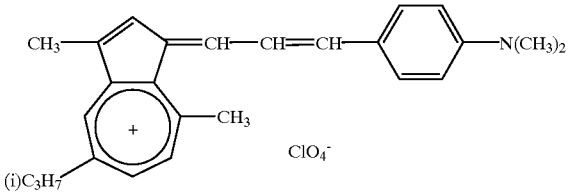
IR7
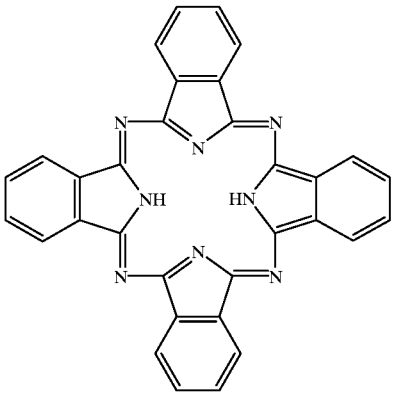
IR8
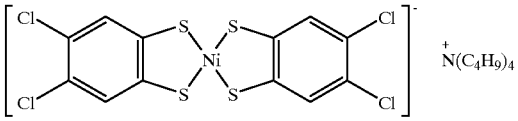
IR9
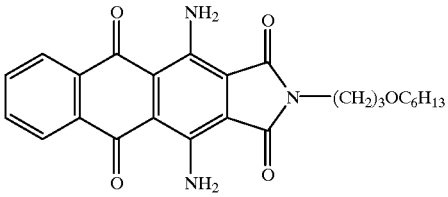
IR10
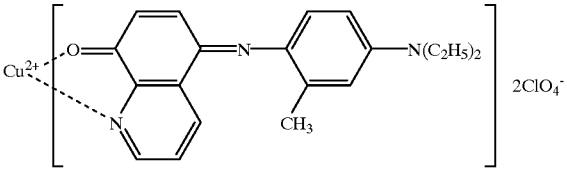
IR11
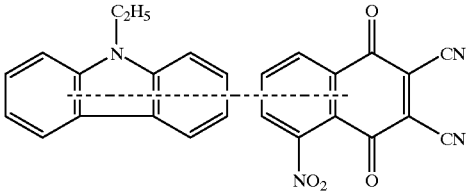

-continued
IR12
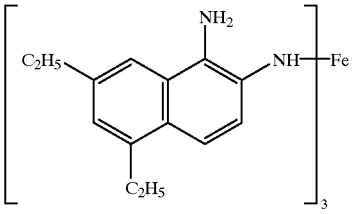
IR13
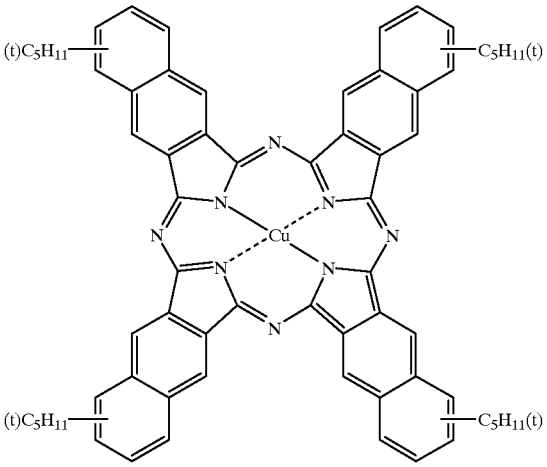
IR14
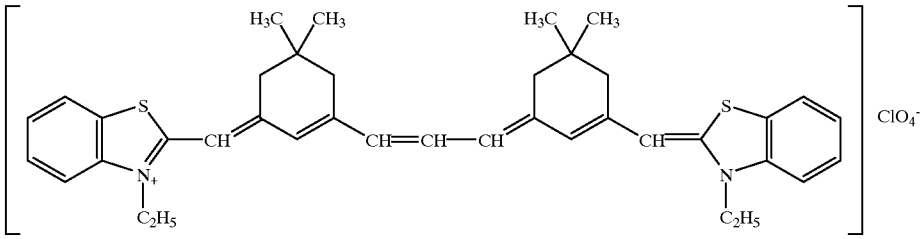
IR15
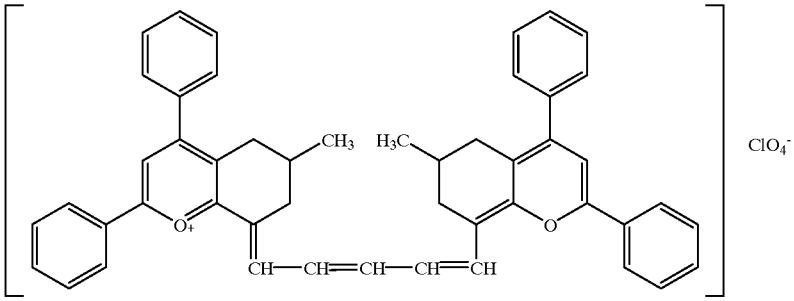

-continued
IR16
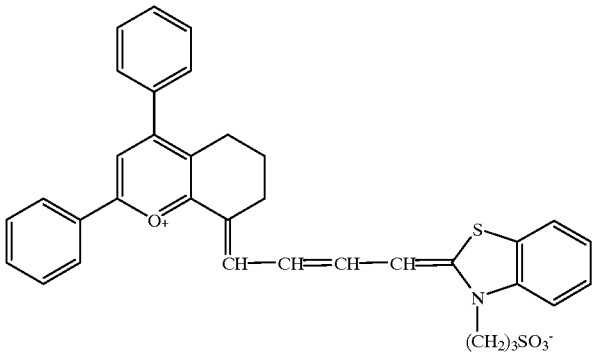
IR17
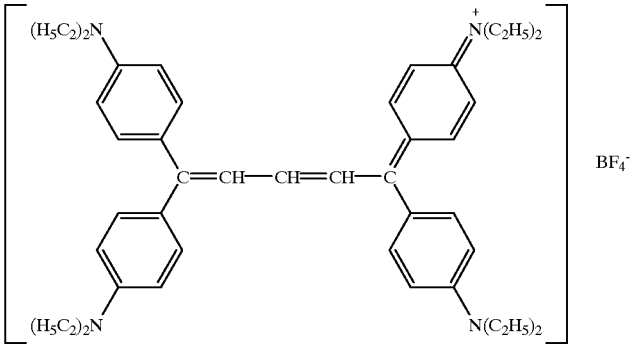
IR18
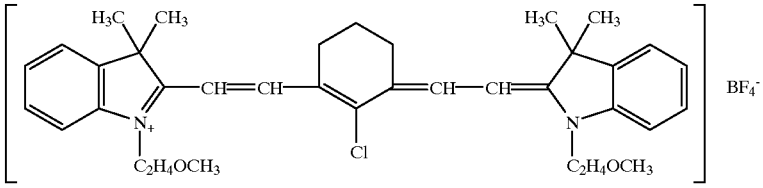
IR19
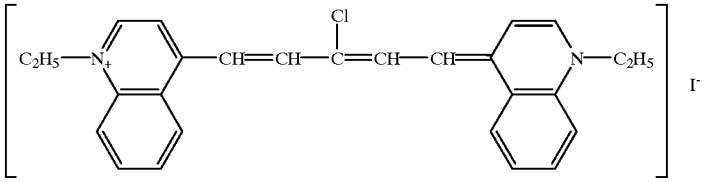
IR20
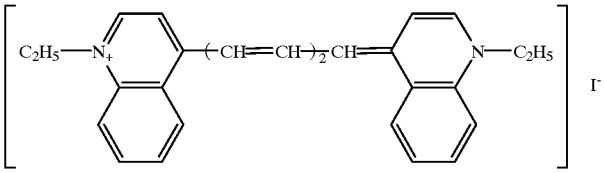
IR21
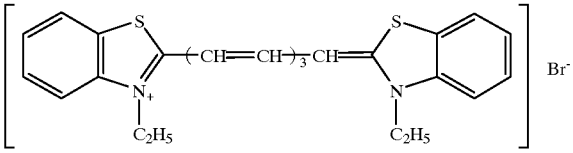

-continued
IR22
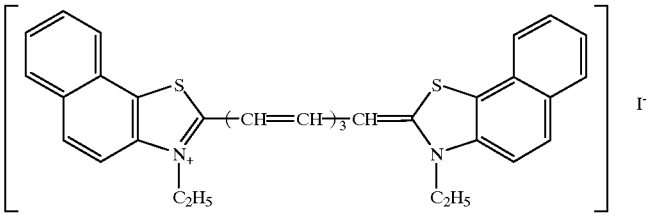
IR23
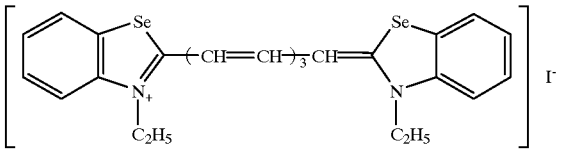
IR24
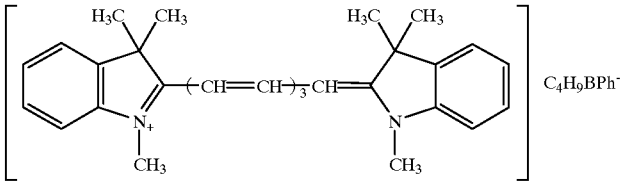
IR25
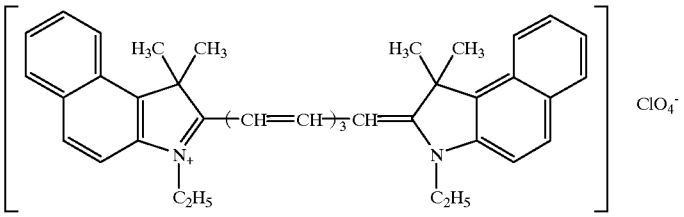
IR26
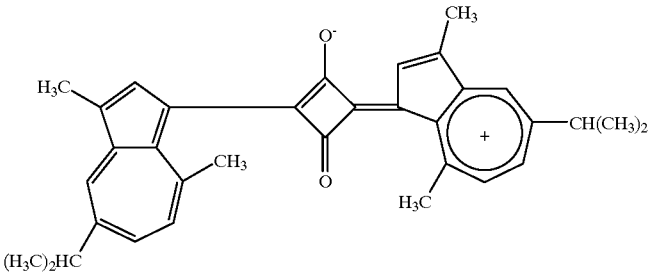
IR27
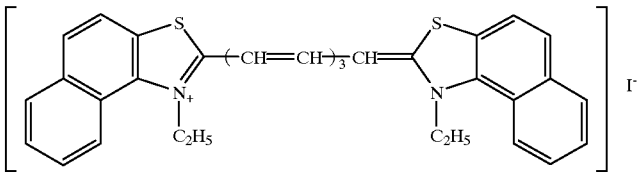
IR28
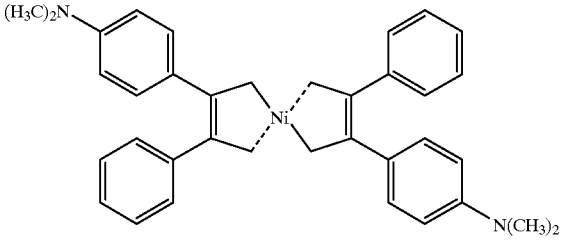

-continued
IR29
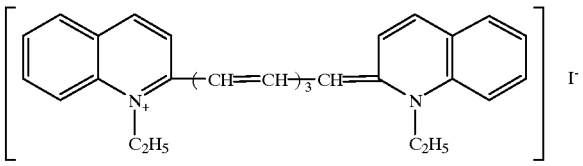
IR30
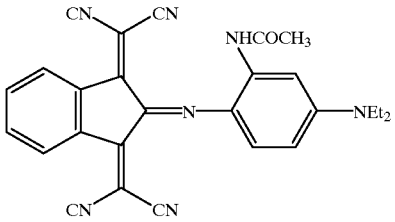
IR31
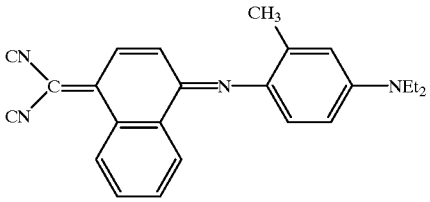
IR32
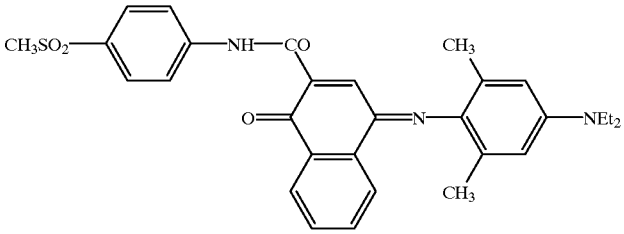
IR33
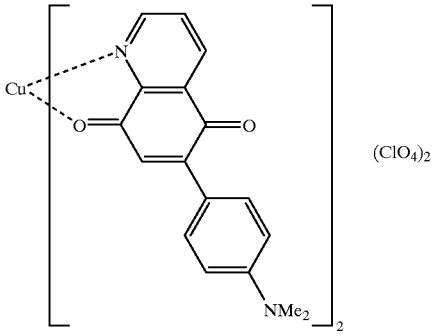
IR34
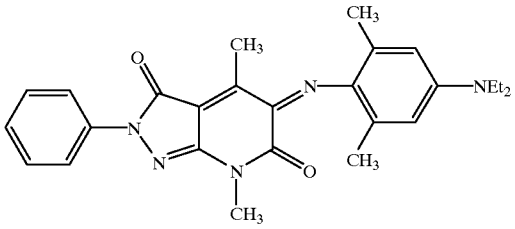

-continued
IR35
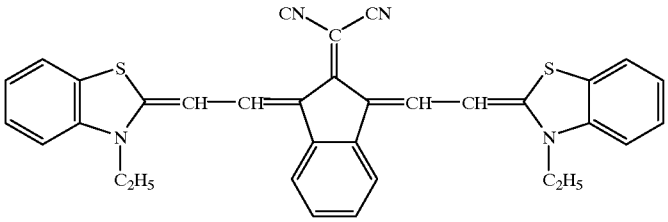
IR36
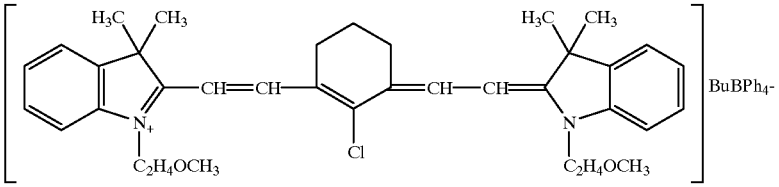
IR37
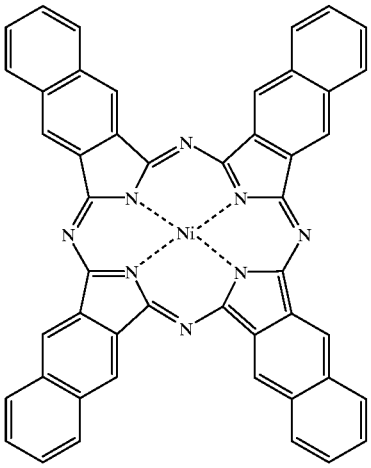
IR38
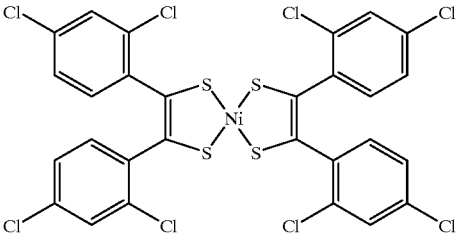
IR39
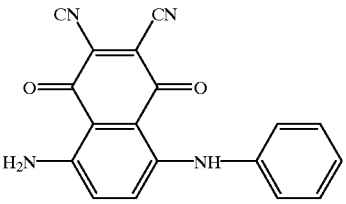
IR40
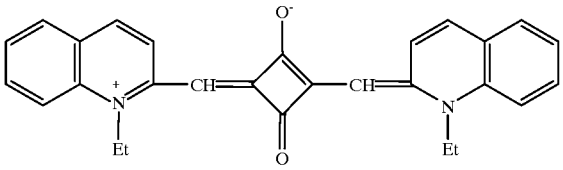

-continued
IR41
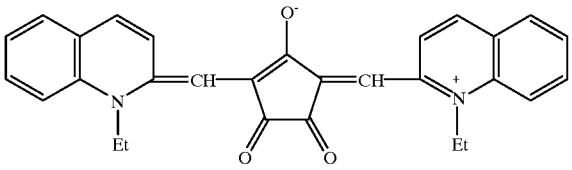
IR42
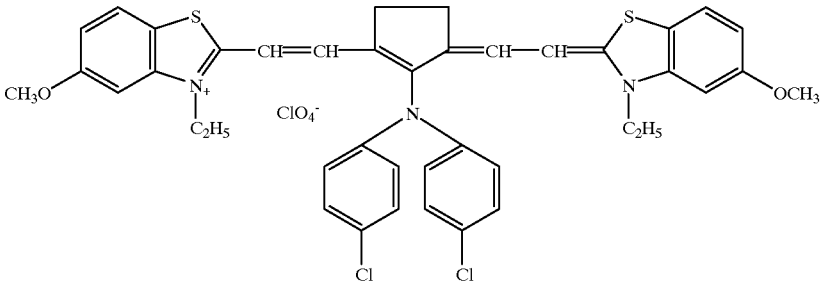
IR43
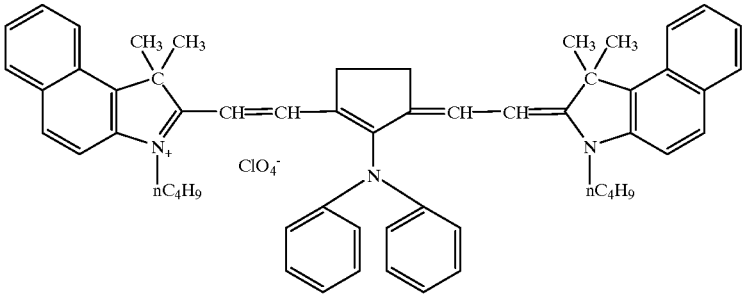
IR44
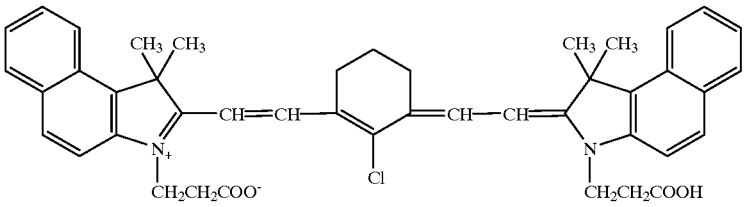
IR45
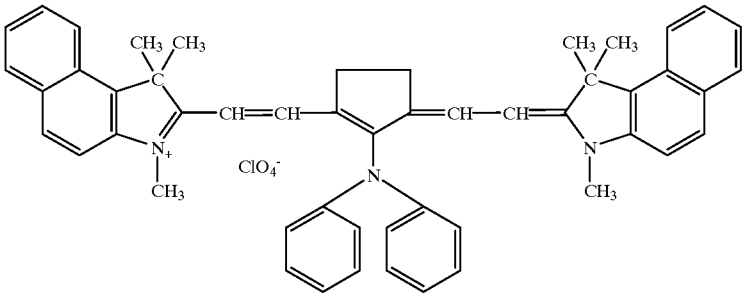
IR46
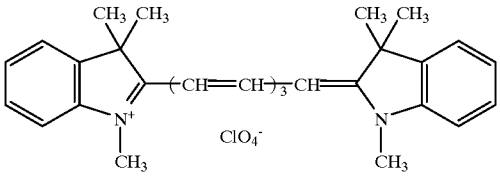

-continued
IR47
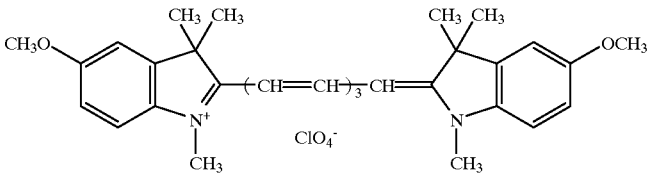
IR48
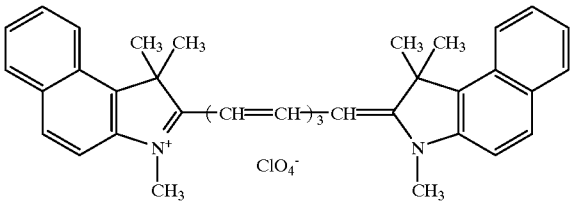
IR49
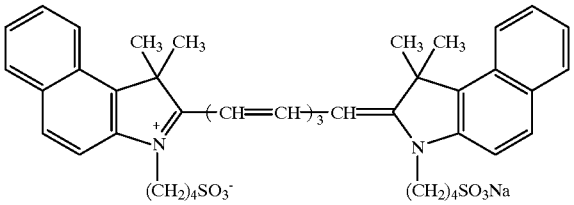
IR50
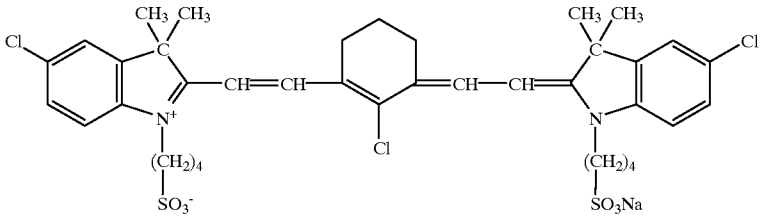
IR51
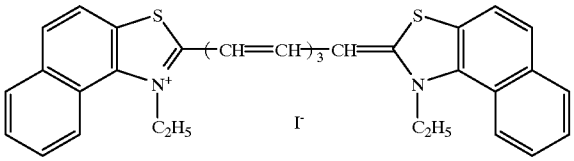
IR52
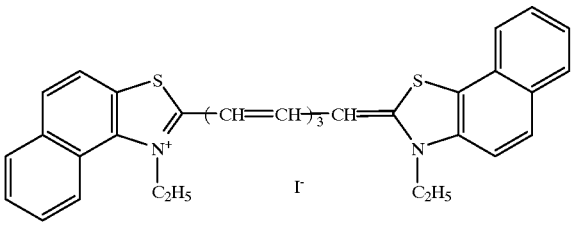
IR53
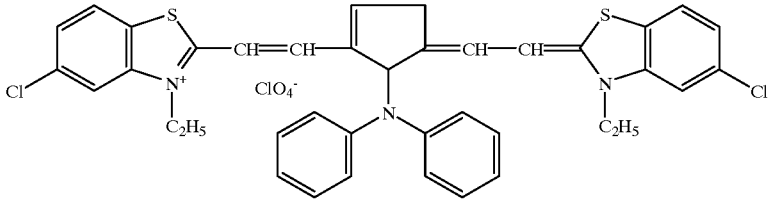

-continued

IR54

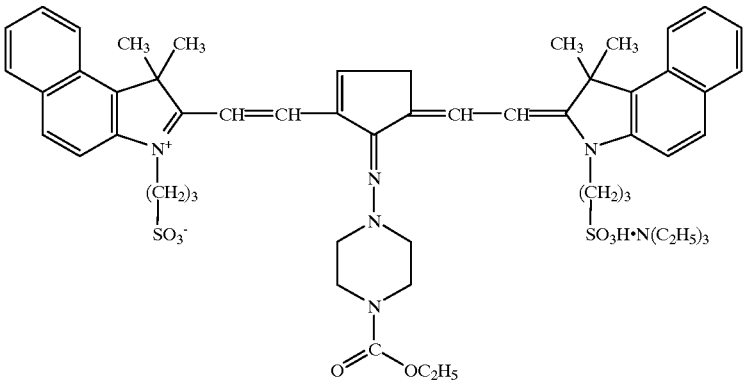

IR55

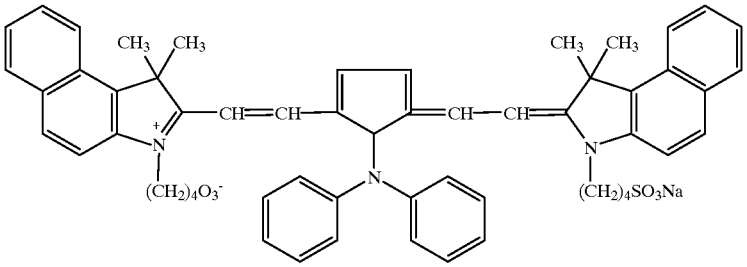

IR56

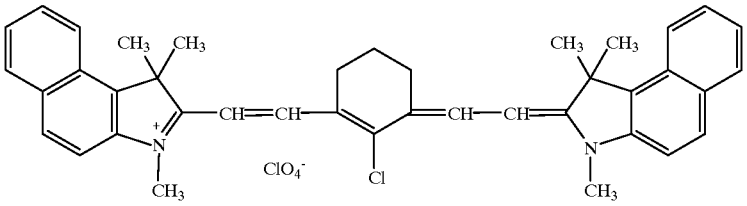

These dyes can be obtained by a conventional synthetic method, and the following commercially available dyes can be used:

IR750 (antraquinone type); IR002 and IR003 (aluminum type), IR820 (polymethine type); IRG022 and IRG033 (diimmonium type); CY-2, CY-4, CY-9 and CY-20, each produced by Nihon Kayaku Co., Ltd.;

KIR103 and SIR103 (phthalocyanine type); KIR101 and SIR114 (antraquinone type); PA1001, PA1005, PA1006 and SIR128, (metal complex type), each produced by Mitsui Toatsu Co., Ltd.;

Fastogen Blue 8120 produced by Dainihon Ink Kagaku Co., Ltd.; and

MIR-101,1011, and 1021 each produced by Midori Kagaku Co., Ltd.

Other infrared dyes are sold by Nihon Kankoshikiso Co., Ltd., Sumitomo Kagaku Co., Ltd. or Fuji Film Co., Ltd.

In the invention, the content of the infrared absorber in the light sensitive composition is preferably 0.5 to 10% by weight based on the total weight of solid components of the light sensitive composition.

(Binder)

The binder used in the light sensitive composition of the invention includes the alkali soluble resin such as the novolak resin, the vinyl polymer having a phenolic hydroxy group, or the polycondensate of polyhydric phenol with aldehyde or ketone as described above.

In the invention, the content of the binder in the light sensitive composition is preferably 20 to 90% by weight, and more preferably 30 to 80% by weight based on the total weight of solid components of the light sensitive composition.

In the invention, a print-out material is used to form a visible image after exposure. The print-out material is composed of a compound capable of producing an acid or free radical on light exposure and an organic dye varying its color on reaction with the free radical or acid. The example of the compound capable of producing an acid or free radical on light exposure includes o-naphthoquinonediazide-4-sulfonic acid halogenide disclosed in Japanese Patent O.P.I. Publication No. 50-36209, a trihalomethylpyrone or trihalomethyltriazine disclosed in Japanese Patent O.P.I. Publication No. 53-36223, an ester compound of o-naphthoquinonediazide-4-sulfonic acid chloride with a phenol having an electron-attractive group or an amide compound of o-naphthoquinonediazide-4-sulfonic acid chloride with aniline disclosed in Japanese Patent O.P.I. Publication No. 55-6244, a halomethylvinyloxadiazole or diazonium salt disclosed in Japanese Patent O.P.I. Publication Nos. 55-77742 and 57-148784. The organic dye includes Victoria Pure Blue BOH (produced by Hodogaya Kagaku Co. Ltd.), Patent Pure Blue (produced by Sumitomomikuni Kagaku Co. Ltd.), Oil Blue #603 (produced by Orient Kagaku Co. Ltd.), Sudan Blue II (produced by BASF), Crystal Violet, Malachite Green, Fuchsin, Methyl Violet, Ethyl Violet, Methyl Orange, Brilliant green, Eosine, Congo Red and Rhodamine 66.

The light sensitive composition in the invention optionally contains a plasticizer, a surfactant, an organic acid or an acid anhydride, besides the above described.

The light sensitive composition in the invention may further contain an lipophilic agent for improving a lipophilicity of image portions such as a p-tert-butylphenol-formaldehyde resin, a p-n-octylphenol-formaldehyde resin or their resins thereof partially esterified with an o-quinonediazide compound.

The light sensitive layer in the invention can be formed by dissolving or dispersing the light sensitive composition in a solvent to obtain a coating solution, coating the solution on a support and then drying the coated.

The solvent for dissolving the light sensitive composition includes methylcellosolve, methylcellosolve acetate, ethylcellosolve, ethylcellosolve acetate, diethylene glycol monomethylether, diethylene glycol monoethylether, diethylene glycol dimethylether, diethylene glycol methylethylether, diethylene glycol diethylether, diethylene glycol monoisopropylether, propylene glycol, propylene glycol monoethylether acetate, propylene glycol monobutylether, dipropylene glycol monomethylether, dipropylene glycol dimethylether, dipropylene glycol methylethylether, ethyl formate, propyl formate, butyl formate, amyl formate, methyl acetate, ethyl acetate, propyl acetate, butyl acetate, methyl propionate, ethyl propionate, methyl butyrate, ethyl butyrate, dimethylformamide, dimethylsulfoxide, dioxane, acetone, methylethylketone, cyclohexanone, methylcyclohexanone, discetonealcohol, acetylacetone, γ-butyrolactone. These solvents can be used singly or in combination.

The coating method for coating the light sensitive composition on a support includes a conventional coating method such as whirl coating, dip coating, air-knife coating, spray coating, air-spray coating, static air-spray coating, roll coating, blade coating or curtain coating. The coating amount is preferably 0.05 to 5.0 g/m$^2$ as a solid, although the amount varies depending on the usage.

The dry coating amount of the light sensitive layer is preferably 0.8 to 1.8 g/m$^2$, and more preferably 1.2 to 1.6 g/m$^2$. The light sensitive layer optionally contains a matting agent.

A protective layer can be provided on the surface of the support opposite the light sensitive layer as disclosed in Japanese Patent O.P.I. Publication Nos. 50-151136, 57-63293, 60-73538, 61-67863 and 6-35174, whereby dissolution of an aluminum support in a developing solution is prevented or the light sensitive layer scratching damage is minimized when presensitized planographic printing plates are stacked.

Similarly, the protective layer can be provided on the light sensitive layer. The protective layer preferably has a high solubility in the developing solution (generally an alkaline solution). The compound used in the protective layer includes polyvinyl alcohol, polyvinyl pyrrolidone, gelatin, casein, gum arabic, and a water soluble amide.

Imagewise exposure is carried out employing an ordinary analogue light source or laser scanning. The various laser can be used in accordance with the spectral sensitivity or sensitivity of the light sensitive layer. The laser for imagewise exposure includes a helium-cadmium laser, an argon ion laser, a helium-neon laser, a semiconductor laser, a YAG laser or a combination of the YAG laser and an optical element in which the wavelength is halved.

EXAMPLES

Example 1

(Support)

A 0.24-mm-thick aluminum plate (material 1050, refining H 16) was immersed in a 1% sodium hydroxide aqueous solution kept at 50° C. for 5 seconds, etched to give an aluminum dissolution amount of 2.0 g/m$^2$, washed with water, immersed at 25° C. for 10 seconds in an aqueous solution having the same composition as an electrolyte solution employed in the following electrolytical surface-roughening treatment, neutralized, and then washed with water. Then, the resulting aluminum plate was electrolytically surface-roughened employing an alternating current having a waveform as shown in FIGS. 1(*a*) through 1(*f*) and conditions as shown in Table 1. Thus, supports 1 through 20 were obtained. In this process, after the electrolytic surface-roughening, the plate was immersed in a 1% sodium hydroxide aqueous solution kept at 50° C. to be etched so that a dissolution amount including a smut amount is 2.0 g/m$^2$, then immersed for 10 seconds in a 10% sulfuric acid aqueous solution kept at 25° C. to be neutralized, and then was washed with water. After that, the plate was subjected to anodization in a 20% sulfuric acid aqueous solution applying a quantity of electricity of 150° C./dm$^2$ and a direct voltage of 20 V to obtain a support.

FIGS. 1(*a*) through (*f*) show examples of alternating current waveforms in which the polarity alternatingly varies.

In FIGS. 1(*a*) through (*f*), the ordinates show an electric current density, and abscissas show time. The 2.0 msec and 1.5 msec, described on the left side of FIGS. 1(*a*) through 1(*e*), show the time $t_1$ taken from a zero current density to the largest current density in the positive polarity period of one cycle, and the 1.0 msec, described on the right side of FIGS. 1(*c*) and 1(*d*), shows the time $t_2$ taken from the finally occurring current density minimum in the negative polarity period of one cycle to a zero current density in the negative polarity period of one cycle. FIG. 1(*f*) shows an alternating current waveform in which $t_1$ taken from a zero current density to the largest current density in the positive polarity period of one cycle is substantially 0 msec (less than 1 msec).

TABLE 1

| Support No. | Electrolyte solution (g/liter) Hydrochloric acid | Acetic acid | Nitric acid | Current density for electrolysis (A/dm$^2$) | Quantity of electricity per one electrolysis step (C/dm$^2$) | Frequency of electrolysis steps (times) | Total quantity of electricity for electrolysis (C/dm$^2$) | *Time of a step with no electrolysis (seconds) | Waveform used for electrolysis as shown by FIG. No.) | Frequency (Hz) | $t_1$/ Positive polarity period time | $t_2$/ Negative polarity period time | Remarks |
|---|---|---|---|---|---|---|---|---|---|---|---|---|---|
| 1 | 10.0 | 0 | 0 | 40 | 480 | 1 | 480 | — | (c) | 60 | 1/5 | 1/5.5 | Inv. |
| 2 | 10.0 | 0 | 0 | 40 | 480 | 1 | 480 | — | (d) | 60 | 1/5 | 1/5.5 | Inv. |
| 3 | 10.0 | 0 | 0 | 40 | 40 | 12 | 480 | 2 | (a) | 50 | 1/5 | 0 | Inv. |
| 4 | 10.0 | 0 | 0 | 40 | 40 | 12 | 480 | 2 | (b) | 50 | 1/5 | 0 | Inv. |
| 5 | 10.0 | 0 | 0 | 40 | 40 | 12 | 480 | 2 | (e) | 50 | 1/5.5 | 0 | Inv. |

TABLE 1-continued

| Support No. | Electrolyte solution (g/liter) Hydrochloric acid | Acetic acid | Nitric acid | Current density for electrolysis (A/dm$^2$) | Quantity of electricity per one electrolysis step (C/dm$^2$) | Frequency of electrolysis steps (times) | Total quantity of electricity for electrolysis (C/dm$^2$) | *Time of a step with no electrolysis (seconds) | Waveform used for electrolysis as shown by FIG. No.) | Frequency (Hz) | $t_1$/ Positive polarity period time | $t_2$/ Negative polarity period time | Remarks |
|---|---|---|---|---|---|---|---|---|---|---|---|---|---|
| 6 | 10.0 | 20.0 | 0 | 20 | 480 | 1 | 480 | — | (a) | 50 | 1/5 | 0 | Inv. |
| 7 | 10.0 | 20.0 | 0 | 20 | 480 | 1 | 480 | — | (b) | 50 | 1/5 | 0 | Inv. |
| 8 | 10.0 | 20.0 | 0 | 20 | 480 | 1 | 480 | — | (c) | 50 | 1/5.5 | 1/6 | Inv. |
| 9 | 10.0 | 20.0 | 0 | 20 | 480 | 1 | 480 | — | (d) | 50 | 1/5.5 | 1/6 | Inv. |
| 10 | 10.0 | 20.0 | 0 | 20 | 480 | 1 | 480 | — | (e) | 60 | 1/5 | 0 | Inv. |
| 11 | 10.0 | 20.0 | 0 | 30 | 40 | 12 | 480 | 2 | (a) | 50 | 1/5 | 0 | Inv. |
| 12 | 10.0 | 20.0 | 0 | 30 | 40 | 12 | 480 | 3 | (b) | 50 | 1/5 | 0 | Inv. |
| 13 | 10.0 | 20.0 | 0 | 30 | 40 | 12 | 480 | 2 | (c) | 50 | 1/5.5 | 1/6 | Inv. |
| 14 | 10.0 | 20.0 | 0 | 30 | 40 | 12 | 480 | 3 | (d) | 50 | 1/5.5 | 1/6 | Inv. |
| 15 | 10.0 | 20.0 | 0 | 30 | 40 | 12 | 480 | 2 | (e) | 60 | 1/5 | 0 | Inv. |
| 16 | 0 | 0 | 15.0 | 50 | 500 | 1 | 500 | — | (a) | 50 | 1/5 | 0 | Inv. |
| 17 | 0 | 0 | 15.0 | 50 | 500 | 1 | 500 | — | (b) | 50 | 1/5 | 0 | Inv. |
| 18 | 0 | 0 | 15.0 | 50 | 500 | 1 | 500 | — | (e) | 50 | 1/5.5 | 0 | Inv. |
| 19 | 10.0 | 0 | 0 | 40 | 480 | 1 | 480 | — | (f) | 60 | 0 | 0 | Comp. |
| 20 | 0 | 0 | 15.0 | 50 | 500 | 1 | 500 | — | (f) | 60 | 0 | 0 | Comp. |

Inv.: Invention, Comp.: Comparative
*Time of a step with no electrolysis refers to time during which electrolysis stops between each of the electrolysis steps.

Next, each of light-sensitive coating solutions having the following compositions was coated on each support by the use of a wire bar, and dried at 80° C. to obtain a light sensitive layer with a dry thickness of 1.6 g/m$^2$. Thus, presensitized planographic printing plate samples 1 through 20 were obtained.

Light Sensitive Composition 1

| | |
|---|---|
| Polymer 1 | 0.20 g |
| Hydroxypropyl-β-cyclodextrin | 0.20 g |
| Novolak resin-1 (phenol/m-cresol/p-cresol 10/54/36, mol ratio), Mw: 4,000) | 3.70 g |
| Novolak resin-2 (phenol/m-cresol/p-cresol 20/50/30, mol ratio), Mw: 8,000) | 3.30 g |
| Condensation product(esterification rate: 30%) of a pyrogallol-acetone resin (Mw: 3,000) with o-naphthoquinone diazide-5-sulfonylchloride | 1.50 g |
| Polyethylene glycol #2,000 | 0.20 g |
| Victoria Pure Blue BOH (made by Hodogaya Kagaku Co., Ltd.) | 0.09 g |
| 2,4-Bis(trichloromethyl)-6-(p-methoxystyryl)-s-triazine | 0.15 g |
| Fluorosurfactant FC-430 (made by Sumitomo 3M Co., Ltd.) | 0.05 g |
| Cis-1,2-Cyclohexanedicarboxylic acid | 0.20 g |
| Methyl ethyl ketone/propylene glycol monomethyl ether = 3/7 by weight %) | 90.0 g |

Polymer 1

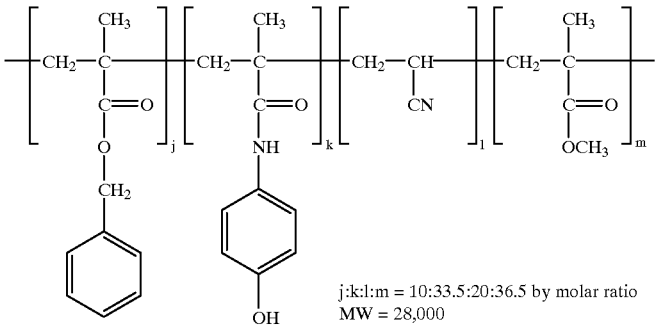

j:k:l:m = 10:33.5:20:36.5 by molar ratio
MW = 28,000

Light Sensitive Composition 2

| | |
|---|---|
| Polymer 2 | 0.50 g |
| Novolak resin-3 (phenol/m-cresol/p-cresol 10/54/36, mol ratio), Mw: 3,500) | 6.50 g |
| Condensation product(esterification rate: 30%) of a pyrogallol-acetone resin (Mw: 2,000) with o-naphthoquinone diazide-5-sulfonylchloride | 1.70 g |
| Polyethylene glycol #2,000 | 0.20 g |
| Victoria Pure Blue BOH (made by Hodogaya Kagaku Co., Ltd.) | 0.08 g |
| 2,4-Bis(trichloromethyl)-6-(p-methoxystyryl)-s-triazine | 0.15 g |
| FC-430 (made by Sumitomo 3M Co., Ltd.) | 0.03 g |
| Cis-1,2-Cyclohexanedicarboxylic acid | 0.15 g |
| Methyl cellosolve/ethyl cellosolve = 3/7 by weight %) | 80.0 g |

Polymer 2

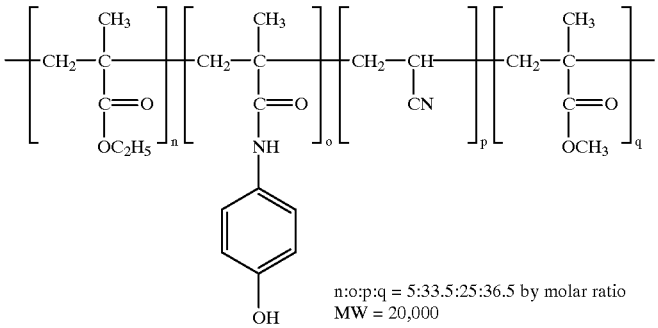

n:o:p:q = 5:33.5:25:36.5 by molar ratio
MW = 20,000

30

Light Sensitive Composition 3

| | |
|---|---|
| Polymer 3 | 1.20 g |
| Novolak resin-4 (phenol/m-cresol/p-cresol 5/57/38, mol ratio), Mw: 4,000) | 6.50 g |
| Condensation product (esterification rate: 30%) of a pyrogallol-acetone resin (Mw: 1,500) with o-naphthoquinone diazide-5-sulfonylchloride | 1.40 g |
| Condensation product (esterification rate: 40%) of a p-cresol.formaldehyde resin (Mw: 2,000) with o-naphthoquinone diazide-5-sulfonylchloride | 0.30 g |
| Polyethylene glycol #2,000 | 0.20 g |
| Victoria Pure Blue BOH (made by Hodogaya Kagaku Co., Ltd.) | 0.06 g |
| Ethyl violet | 0.02 g |
| 2,4-Bis(trichloromethyl)-6-(p-methoxystyryl)-s-triazine | 0.15 g |
| FC-430 (made by Sumitomo 3M Co., Ltd.) | 0.03 g |
| Cis-1,2-Cyclohexanedicarboxylic acid | 0.20 g |
| Methyl cellosolve/ethyl cellosolve = 3/7 | 77.0 g |

Polymer 3

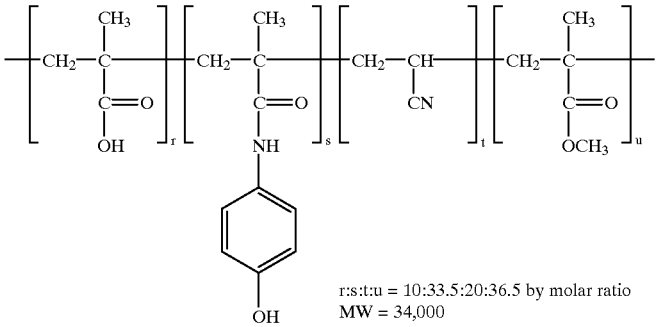

r:s:t:u = 10:33.5:20:36.5 by molar ratio
MW = 34,000

Light Sensitive Composition 4

| | |
|---|---|
| m-Cresol.formaldehyde novolak resin (Mw: 1,700) | 0.30 g |
| Cresol.formaldehyde novolak resin (m-cresol/p-cresol 80/20, mol ratio, Mw: 3,000) | 1.10 g |
| Condensation product of a pyrogallol-acetone resin with o-naphthoquinone diazide-5-sulfonylchloride (disclosed in U.S. Pat. No. 3,635,709) | 0.45 g |
| Tetrahydro phthalic anhydride | 0.10 g |
| Benzoic acid | 0.02 g |
| t-Butylphenol resin (disclosed in U.S. Pat. No. 4,123,279) | 0.01 g |
| Oil blue #603 (made by Orient Kagaku Kogyo Co., Ltd.) | 0.04 g |
| 4-[p-N-(p-hydroxybenzoyl) aminophenyl]-2,6-bis(trichloromethyl)-s-triazine | 0.02 g |
| Megafac F177 (made by Dainihon ink Kagaku Kogyo Co., Ltd.) | 0.02 g |
| Methyl ethyl ketone | 15.0 g |
| Methyl isobutyl ketone | 5.0 g |
| Propylene glycol monomethyl ether | 10.0 g |

(Evaluation of uniformity of pits)

The support surface was photographed by means of a 500 power SEM. Using the resulting 500 power SEM photograph, uniformity of the large pits and small pits was evaluated according to good/poor criteria. The large pits herein referred to implies dual-structured pits having an opening size exceeding 2 μm and further having additional pits of 2 μm or less in the inner walls, while the small pits herein referred to implies ones having an opening size of 0.1 to 2 μm without additional pits in the inner walls. Pits having an opening size of less than 0.1 μm were ignored.

(Preparation of Planographic Printing Plate)

Each presensitized planographic printing plate obtained above was exposed at 8 mw/cm2 for 60 seconds employing a 4 kw metal halide lamp. The exposed plate was then developed at 27° C. for 20 seconds employing a developer obtained by diluting with water by 6 factors a commercially available developer SDR-1 (made by Konica Corporation) to obtain a planographic printing plate. The resulting printing plate was evaluated according to the following methods.

(Evaluation of anti-staining property at less dampening water supplying)

The printing plate obtained above was mounted on a printing machine (DAIYA1F-1 produced by Mitsubishi Jukogyo Co., Ltd.), and printing was carried out using coated paper, dampening water (Etch Solution SG-51 (Concentration 1.5%) produced by Tokyo Ink Co., Ltd.) and printing ink (Hyecho M magenta produced by Toyo Ink Manufacturing Co., Ltd.) to give an image density of 1.6. Anti-staining property at less dampening water supplying (i.e. less dilution) was measured and evaluated according to good/poor criteria.

(Evaluation of printing property)

Printing was carried out employing printing paper with poor ink absorption. Printing was carried out in the same manner as above, except that YUPO paper was used instead of coated paper, and printing property was evaluated according to good/poor criteria.

(Evaluation of residual ball point pen ink)

Ball point pen ink (blue ink) was provided with a 75 g load applied on each of the light sensitive layers of the above obtained presensitized planographic printing plate samples. The resulting plate sample was entirely exposed to a 4 KW metal halide lamp for 60 seconds, 90 cm distant from the lamp, and developed at 27° C. for 20 seconds with a developer obtained by diluting, with water by a factor of 6, a commercially available developer SDR-1 produced by Konica Corporation. Then, residual ball point pen ink remained on the support surface of the developed sample was visually evaluated.

The evaluation was carried out according to ten-step evaluation criteria. A maximum of 10 implies that ink was completely removed with no residual ink, and 1 implies that ink was not removed.

TABLE 2

| Sample No | Support No. | Light sensitive composition used | Uniformity of large pits | Uniformity of small pits | Anti-staining property at less dampening water supplying | Printing property in employing YUPO paper | Residual ball point pen ink (evaluation marks) | Remarks |
|---|---|---|---|---|---|---|---|---|
| 1 | 1 | 2 | good | good | excellent | excellent | 9 | Inv. |
| 2 | 2 | 4 | good | good | good | good | 10 | Inv. |
| 3 | 3 | 3 | good | good | excellent | excellent | 10 | Inv. |
| 4 | 4 | 2 | good | good | good | good | 9 | Inv. |
| 5 | 5 | 1 | good | good | excellent | excellent | 9 | Inv. |
| 6 | 6 | 3 | excellent | excellent | excellent | excellent | 10 | Inv. |
| 7 | 7 | 3 | excellent | excellent | good | good | 9 | Inv. |
| 8 | 8 | 4 | excellent | excellent | excellent | excellent | 9 | Inv. |
| 9 | 9 | 1 | excellent | excellent | good | good | 9 | Inv. |
| 10 | 10 | 2 | excellent | excellent | excellent | excellent | 10 | Inv. |
| 11 | 11 | 2 | excellent | excellent | excellent | excellent | 10 | Inv. |
| 12 | 12 | 1 | excellent | excellent | good | good | 10 | Inv. |
| 13 | 13 | 2 | excellent | excellent | excellent | excellent | 10 | Inv. |
| 14 | 14 | 4 | excellent | excellent | good | good | 9 | Inv. |
| 15 | 15 | 3 | excellent | excellent | excellent | excellent | 9 | Inv. |
| 16 | 16 | 2 | good | good | good | good | 8 | Inv. |
| 17 | 17 | 3 | good | good | good | good | 8 | Inv. |
| 18 | 18 | 4 | good | good | good | good | 8 | Inv. |
| 19 | 19 | 4 | good | poor | good | poor | 1 | Comp. |
| 20 | 20 | 4 | poor | poor | poor | poor | 1 | Comp. |

Inv.: Invention, Comp.: Comparative

As is apparent from Table 2, the inventive samples provide superior results in uniformity of large pits, uniformity of small pits, anti-staining property at less dampening water supplying, printing property in employing YUPO paper, and residual ball point pen ink as compared to comparative samples.

What is claimed is:

1. A method of surface-roughening an aluminum support, the method comprising the step of:

electrolytically surface-roughening an aluminum support in an electrolyte solution, supplying an alternating current with an alternating waveform having a positive polarity period and a negative polarity period in one cycle, and comprising arriving at the largest current value from a zero current value in the positive polarity period of one cycle and then falling, followed by rising to a current maximum in one cycle, wherein the time $t_1$, which is required to arrive at the largest current value, has the following relationships:

1 millisecond$<t_1 \leqq$10 milliseconds, and 1 millisecond$<t_1 \leqq$one third of the positive polarity period time.

2. The method of claim 1, wherein the time $t_1$ has the following relationships:

1 millisecond$<t_1 \leqq$5 milliseconds, and 1 millisecond$<t_1 \leqq$one third of the positive polarity period time.

3. The method of claim 2, wherein the time $t_1$ has the following relationships:

1 millisecond$<t_1 \leqq$3 milliseconds, and 1 millisecond$<t_1 \leqq$one fourth of the positive polarity period times.

4. The method of claim 1, wherein the alternating waveform has one to five current maximums occurring after said falling in one cycle.

5. The method of claim 1, further comprising the step of anodizing the surface roughened support to form an anodization layer.

6. The method of claim 5, wherein the thickness of the anodization layer is 0.5 to 5.0 g/m$^2$.

7. The method of claim 1, wherein the alternating waveform further comprises arriving at a zero current value from a finally occurring current minimum in the negative polarity period of one cycle, wherein the time $t_2$, which is required to arrive at the zero current value in the negative polarity period, has the following relationships:

$0 \leqq t_2 \leqq$10 milliseconds, and $0 \leqq t_2 \leqq$one third of the negative polarity period time.

8. The method of claim 1, wherein the quantity of electricity supplied in the surface-roughening step is 100 to 2000° C./dm$^2$.

9. A method of manufacturing a presensitized planographic printing plate, the method comprising the steps of:

electrolytically surface-roughening an aluminum support in an electrolyte solution, supplying an alternating current with an alternating waveform having a positive polarity period and a negative polarity period in one cycle, and comprising arriving at the largest current value from a zero current value in the positive polarity period of one cycle and then falling, followed by rising to a current maximum in one cycle, wherein the time $t_1$, which is required to arrive at the largest current value, has the following relationships:

1 millisecond$<t_1 \leqq$10 milliseconds, and 1 millisecond$<t_1 \leqq$one third of the positive polarity period time; and providing a light sensitive layer on the surface-roughened support.

10. The method of claim 9, wherein the light sensitive layer contains an o-quinonediazide compound.

* * * * *